US012281438B2

(12) United States Patent
Barguet et al.

(10) Patent No.: US 12,281,438 B2
(45) Date of Patent: Apr. 22, 2025

(54) METHOD FOR SEPARATION AND REASSEMBLY

(71) Applicant: COMPAGNIE GENERALE DES ETABLISSEMENTS MICHELIN, Clermont-Ferrand (FR)

(72) Inventors: Henri Barguet, Clermont-Ferrand (FR); Olivier Reix, Clermont-Ferrand (FR); Gael Pataut, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 451 days.

(21) Appl. No.: 17/629,848

(22) PCT Filed: Jul. 22, 2020

(86) PCT No.: PCT/FR2020/051336
§ 371 (c)(1),
(2) Date: Jan. 25, 2022

(87) PCT Pub. No.: WO2021/014097
PCT Pub. Date: Jan. 28, 2021

(65) Prior Publication Data

US 2022/0251780 A1 Aug. 11, 2022

(30) Foreign Application Priority Data

Jul. 25, 2019 (FR) ..... 1908427

(51) Int. Cl.
*D07B 3/00* (2006.01)
*D07B 1/06* (2006.01)
*D07B 7/02* (2006.01)

(52) U.S. Cl.
CPC ..... *D07B 3/00* (2013.01); *D07B 1/0646* (2013.01); *D07B 7/025* (2013.01);
(Continued)

(58) Field of Classification Search
CPC ..... D07B 3/00; D07B 1/0646; D07B 7/025; D07B 2207/204; D07B 2207/4018
See application file for complete search history.

(56) References Cited

U.S. PATENT DOCUMENTS 1,906,543 A 5/1933 Conner
2,000,104 A 5/1935 Somerville
(Continued)

FOREIGN PATENT DOCUMENTS

CN 102373632 * 2/2012 ..... D07B 3/00
CN 102373632 A 3/2012
(Continued)

OTHER PUBLICATIONS

Machine translation—CN102373632 (Year: 2012).*
International Search Report dated Nov. 9, 2020, in corresponding PCT/FR2020/051336 (4 pages).

*Primary Examiner* — Uyen T Nguyen
(74) *Attorney, Agent, or Firm* — VENABLE LLP

(57) ABSTRACT

The method makes it possible to manufacture an assembly (A) comprising a layer (C) of metal filamentary elements (14) wound in a helix. The method comprises a step (100) of supplying a temporary assembly (22) comprising a layer (13) of M'>1 metal filamentary elements (14) and a temporary centre (16), and a step (110) of separating the temporary assembly (22) between a first split assembly (25), a second split assembly (27) and the temporary centre (16). The method comprises a step (140) of reassembling the first split assembly (25) with the second split assembly (27) so as to form the layer (C) of the assembly (A).

7 Claims, 18 Drawing Sheets

(52) U.S. Cl.
CPC ..... *D07B 2201/2007* (2013.01); *D07B 2201/2021* (2013.01); *D07B 2207/204* (2013.01); *D07B 2207/4018* (2013.01); *D07B 2501/2046* (2013.01)

(56) References Cited

U.S. PATENT DOCUMENTS

| | | | | |
|---|---|---|---|---|
| 2,556,164 | A | 6/1951 | Carleton et al. | |
| 3,327,753 | A | 6/1967 | Travers | |
| 3,789,596 | A | 2/1974 | Richley | |
| 4,437,297 | A * | 3/1984 | Vespasiani | D07B 3/022 57/58.55 |
| 5,802,830 | A | 9/1998 | Kawatani | |
| 6,076,344 | A | 6/2000 | Doujak | |
| 6,109,017 | A | 8/2000 | Kawatani | |
| 6,151,879 | A * | 11/2000 | Doujak | B60C 9/0064 57/284 |
| 6,354,068 | B1 | 3/2002 | Onuma et al. | |
| 6,681,555 | B1 * | 1/2004 | Heisel | D02G 1/082 57/284 |
| 6,904,744 | B2 | 6/2005 | Cauwels et al. | |
| 8,359,823 | B2 | 1/2013 | Qi | |
| 10,364,529 | B2 | 7/2019 | Calvet et al. | |
| 10,378,128 | B2 | 8/2019 | Calvet et al. | |
| 10,426,505 | B2 | 10/2019 | Matsumoto | |
| 10,619,297 | B2 | 4/2020 | Calvet et al. | |
| 2006/0027310 | A1 | 2/2006 | Auclair | |
| 2007/0006957 | A1 | 1/2007 | Nakajima | |
| 2014/0033906 | A1 * | 2/2014 | Erlendsson | D07B 5/005 87/8 |
| 2017/0321352 | A1 * | 11/2017 | Calvet | D02G 3/28 |
| 2017/0321376 | A1 * | 11/2017 | Calvet | D07B 5/007 |
| 2018/0117970 | A1 | 5/2018 | LeClerc et al. | |
| 2018/0161053 | A1 | 6/2018 | Matsumoto | |
| 2018/0171511 | A1 | 6/2018 | Calvet et al. | |
| 2018/0171551 | A1 | 6/2018 | Calvet et al. | |
| 2021/0309050 | A1 | 10/2021 | Cornille et al. | |
| 2022/0258535 | A1 | 8/2022 | Barguet et al. | |
| 2022/0402302 | A1 | 12/2022 | Reix et al. | |
| 2023/0349097 | A1 | 11/2023 | Pataut et al. | |

FOREIGN PATENT DOCUMENTS

| | | | |
|---|---|---|---|
| DE | 102011053240 | A1 | 3/2013 |
| EP | 1623819 | A1 | 2/2006 |
| EP | 2845620 | A1 | 3/2015 |
| EP | 3165670 | A1 | 5/2017 |
| EP | 3293306 | A1 | 3/2018 |
| FR | 1413102 | | 10/1965 |
| WO | 2016/083265 | A1 | 6/2016 |
| WO | 2016/083267 | A1 | 6/2016 |
| WO | 2016/189073 | A1 | 12/2016 |
| WO | 2016/189074 | A1 | 12/2016 |
| WO | 2020/021006 | A1 | 1/2020 |
| WO | 2020/021007 | A1 | 1/2020 |

* cited by examiner

METHOD FOR SEPARATION AND REASSEMBLY

BACKGROUND

The invention relates to a method and an installation for manufacturing a final assembly, a final assembly obtained by this method and a tyre comprising such a final assembly.

WO2016083265 and WO2016083267 disclose a method and an installation for manufacturing first and second final assemblies. This method comprises a step of assembling several metal filamentary elements together into a layer of several metal filamentary elements around a transitory core to form a transitory assembly.

The method then comprises a first step of splitting the transitory assembly into:

- a first split assembly made up of a layer made up of several metal filamentary elements wound in a helix and originating from the layer of the transitory assembly, and
- a split ensemble comprising several metal filamentary elements helically wound around the transitory core, these metal filamentary elements originating from the layer of the transitory assembly.

The method then comprises a second step of splitting the split ensemble into:

- a second split assembly made up of a layer made up of metal filamentary elements wound in a helix and originating from the layer of the split ensemble, and
- the transitory core.

At the end of this method, each first and second split assembly forms a final assembly from which the transitory core has been separated. The separation of the transitory core is made possible by the separation of the metal filamentary elements of the layer of the transitory assembly which allows the creation, during the first splitting step, of a passage for the extraction of the split ensemble comprising the transitory core and, during the second splitting step, of a passage for the extraction of the transitory core.

Thanks to the transitory core, the method allows the metal filamentary elements to be preformed collectively by pressing them onto the transitory core in order to confer, upon all of them, the same particular geometric characteristics, for example a radius of curvature and a helix diameter. The use of a transitory core thus allows preforming without the use of mechanical tools. Each final assembly has advantageous mechanical properties, in particular endurance properties in compression, these properties being able to be refined by modifying in particular the diameter of the transitory core and the helix angle of each metal filamentary element.

Nevertheless, during this method, in order to provide the extraction passages for the transitory core and for given geometric characteristics of each metal filamentary element, the number of metal filamentary elements of the layer of each final assembly is necessarily reduced. This reduction in the number of metal filamentary elements of the layer leads to a decrease in the linear density of each final assembly and therefore a reduction in the reinforcement which the final assembly can provide, in particular within a tyre. Conversely, if one wishes to keep a high reinforcement, it is necessary to start from a transitory assembly comprising a high number of metal filamentary elements, which does not make it possible to obtain all the desired geometric characteristics, nor the mechanical properties desired for the final assemblies.

SUMMARY

The invention is aimed at a method for manufacturing a final assembly by means of a collective preforming of these metal filamentary elements around a transitory core, not preventing, on the one hand, maintaining a linear density which is as high as possible and making it possible, on the other hand, to achieve all of the desired geometric characteristics of the metal filamentary elements.

DETAILED DESCRIPTION

To this end, the subject of the invention is a method for manufacturing a final assembly comprising at least one layer made up of N'>1 helically wound metal filamentary elements, the method comprising:

- a step of supplying a transitory assembly comprising at least one layer made up of M'>1 metal filamentary elements helically wound around a transitory core,
- a step of separating the transitory assembly into at least:
  - a first split assembly comprising at least one layer made up of M1'≥1 helically wound metal filamentary element(s), the M1' metal filamentary element(s) originating from the layer made up of M'>1 metal filamentary elements of the transitory assembly,
  - a second split assembly comprising at least one layer made up of M2'>1 helically wound metal filamentary elements, the M2' metal filamentary elements originating from the layer made up of M'>1 metal filamentary elements of the transitory assembly,
  - the transitory core or one or more ensembles comprising the transitory core, the method comprising a step of reassembling at least the first split assembly with the second split assembly to form the layer made up of N' helically wound metal filamentary elements.

According to the invention, M'>1 and implicitly M'>2 because M1'1 and M2'>1.

At the end of the step of separating the transitory assembly, in one variant, the first split assembly, the second split assembly and the transitory core are obtained, the transitory core being isolated from any other metal filamentary element originating from the layer made up of M'>1 metal filamentary elements. In other words, at the end of the step of separating the transitory assembly, in this variant, the first split assembly, the second split assembly and an ensemble made up of the transitory core are obtained.

In another variant, at the end of the step of separating the transitory assembly, the first split assembly, the second split assembly and an ensemble comprising the transitory core are obtained, the ensemble comprising the transitory core also comprising one or more metal filamentary elements originating from the layer made up of M'>1 metal filamentary elements of the transitory assembly. In other words, in this variant, at the end of the step of separating the transitory assembly, the first split assembly, the second split assembly and an ensemble consisting of the transitory core and one or more metal filamentary elements originating from the layer made up of M'>1 metal filamentary elements are obtained.

In yet another variant, at the end of the step of separating the transitory assembly, the first split assembly, the second split assembly and several ensembles each comprising a part of the transitory core are obtained, each ensemble comprising a part of the transitory core also comprising one or more metal filamentary elements originating from the layer made up of M'>1 metal filamentary elements of the transitory assembly. Thus, the ensembles comprise the entire transitory core, and the parts of the transitory core of the ensembles form the transitory core in its entirety. In other words, in this variant, the first split assembly, the second split assembly and several ensembles each made up of a part of the transitory core and one or more metal filamentary elements originating from the layer made up of M'>1 metal filamentary elements of the transitory assembly are obtained, the parts of the transitory core constituting the transitory core.

Thanks to the reassembly step of the method according to the invention, it is possible, for given geometric characteristics, to increase the linear density of the final assembly in relation to the method of the prior art in which the number of metal filamentary elements is necessarily limited, while allowing the extraction of the transitory core. Conversely, for a given linear density, it is possible to obtain a greater range of geometric characteristics than with the method of the prior art.

Another advantage of the method according to the invention is that each metal filamentary element of the final assembly is devoid of preforming marks. Such preforming marks include in particular flats. The preforming marks also include cracks extending in planes of section substantially perpendicular to the main axis along which each metal filamentary element extends. Such cracks extend, in a plane of section substantially perpendicular to the main axis, from a radially external surface of each metal filamentary element radially towards the inside of each metal filamentary element. As described above, such cracks are initiated by the mechanical preforming tools on account of the bending loads, that is to say perpendicularly to the main axis of each metal filamentary element, making them highly detrimental to endurance. By contrast, in the method employed, the metal filamentary elements are preformed collectively and simultaneously on a transitory core, and the preforming loads are exerted in torsion and therefore not perpendicularly to the main axis of each metal filamentary element. Any cracks created do not extend radially from the radially external surface of each metal filamentary element radially towards the inside of each metal filamentary element but along the radially external surface of each metal filamentary element, making them less detrimental to endurance.

The reassembly step is such that N'=M1'+M2'. During this reassembly step, the MI helically wound metal filamentary element(s) forming the layer of the first split assembly are reassembled with the M2' helically wound metal filamentary elements forming the layer of the second split assembly. Reassembling the metal filamentary elements of these two layers makes it possible to obtain the layer of the final assembly.

In the method according to the invention, with each M1' and M2' metal filamentary elements originating from the same layer of the transitory assembly, the reassembly step advantageously makes it possible to form a final assembly in which the N' metal filamentary elements have the same geometric characteristics and therefore form a homogeneous layer of metal filamentary elements. Thus, in order to make it possible in an advantageous embodiment to obtain an assembly in which the metal filamentary elements have identical geometric characteristics, the supply step, the separation step and the reassembly step are carried out so that all the N' metal filamentary elements have the same diameter d, are helically wound at the same pitch p and have the same helix diameter $\phi$. The helix diameter $\phi$ corresponds to the diameter of the theoretical circle passing through the centres of the metal filamentary elements of the layer in a plane perpendicular to axis of the assembly. It will be recalled that the pitch p at which each metal filamentary element is wound is the length covered by this filamentary element, measured parallel to the axis of the assembly in which it is located, after which the filamentary element that has this pitch makes a complete turn about said axis of the assembly.

Furthermore, as described above, according to the various embodiments, the separation step and the reassembly step are carried out in such a way that M'≥M1'+M2'=N'.

The transitory assembly of the method according to the invention comprises the layer formed by the M' metal filamentary elements and the transitory core, the M' metal filamentary elements being helically wound around the transitory core. Preferably, in one embodiment making it possible to manufacture a final assembly consisting of a layer of metal filamentary elements, the transitory assembly consists of the layer constituted by the M' metal filamentary elements and of the transitory core, the M' metal filamentary elements being helically wound around the transitory core.

The method according to the invention is advantageously a continuous or process-line method. Thus, there is no intermediate storage step for the various assemblies and ensembles generated during the method between the step of supplying the transitory assembly and the step of reassembling the final assembly.

In the present invention, a step of splitting an initial object into several final objects means that, during this splitting step, the initial object is divided into the final objects and only these final objects so that the entirety of the initial object goes on to form part of the final objects. In addition, in a splitting step, the initial object is divided into the final objects simultaneously, which is to say that the final objects are separated off at the one same splitting point. In particular, in the case of an initial object that is split into at least three final objects, the three final objects are, during a splitting step, separated from one another simultaneously and at the one same point.

In the present invention, a step of separating an initial object into several final objects means that, in order to obtain these final objects, at least one splitting step is required. Thus, in order to obtain the final objects, the separation step comprises a step of splitting the initial object into the final objects or else comprises a step of splitting the initial object into intermediate objects, followed by one or more successive steps of splitting the intermediate objects into the final objects. Furthermore, in a separation step, the initial object does not necessarily go on in its entirety to form the final objects, since ensembles or assemblies may have been extracted from the method during one or more splitting steps and so not used in later splitting steps. Finally, a separation step may comprise one or more steps of reassembling several intermediate objects originating from a splitting step of the separation step in order to obtain other intermediate objects or else final objects.

Whether during a separation step or during a splitting step, the final objects are physically separated from one another, which is to say not in contact with one another downstream of the separation or splitting steps and upstream of any step of reassembling two or more of these final objects.

The final assembly is a single-helix assembly. By definition, a single-helix assembly is an assembly in which the axis of each metal filamentary element describes a single helix, in contrast to a double-helix assembly, in which the axis of each metal filamentary element describes a first helix about the axis of the assembly and a second helix about a helix described by the axis of the assembly.

In other words, when the assembly extends in a substantially rectilinear direction, the assembly comprising one or more layers of filamentary elements wound in a helix, each metal filamentary element of the or each layer describes a helical path about a main axis substantially parallel to the substantially rectilinear direction, such that, in a plane of section substantially perpendicular to the main axis, the distance between the centre of each metal filamentary element of a given layer and the main axis is substantially constant and identical for all the metal filamentary elements of each given layer. By contrast, when a double-helix assembly extends in a substantially rectilinear direction, the distance between the centre of each metal filamentary element of a given layer and the substantially rectilinear direction is different for all of the metal filamentary elements of the given layer.

A filamentary element means any longilinear element of great length relative to its cross section, whatever the shape of the latter, for example circular, oblong, rectangular or square, or even flat. When it is circular in shape, its diameter is preferably less than 3 mm. Highly preferably, each filamentary element has a circular cross section.

In one embodiment, each metal filamentary element comprises a single elementary metallic monofilament.

In another embodiment, each metal filamentary element comprises an assembly of several elementary metallic monofilaments. Thus, for example, each metal filamentary element comprises a strand of several elementary metallic monofilaments. Each strand preferably comprises one or more layers of elementary metallic monofilaments wound together in a helix.

By definition, metallic is understood to mean an elementary monofilament made up predominantly (i.e. more than 50% of its weight) or entirely (100% of its weight) of a metallic material. Each elementary metallic monofilament is preferentially made of steel, more preferentially perlitic (or ferritic-perlitic) carbon steel referred to as "carbon steel" below, or else made of stainless steel (by definition steel comprising at least 10.5% chromium).

Such an elementary metallic monofilament preferably comprises a steel core, possibly coated with one or more layers of a coating which can be metallic and/or based on a non-metallic adhesive composition. For example, the metallic coating comprises a metal chosen from zinc, copper, tin, cobalt and the alloys of these metals. Mention will be made, as examples of alloys of these metals, of brass and bronze.

When a carbon steel is used, its carbon content (% by weight of steel) is preferably between 0.1% and 1.2%. Each elementary metallic monofilament exhibits a mechanical strength ranging from 1000 MPa to 5000 MPa. Such mechanical strengths correspond to the steel grades commonly encountered in the field of tyres, namely the NT (Normal Tensile), HT (High Tensile), ST (Super Tensile), SHT (Super High Tensile), UT (Ultra Tensile), UHT (Ultra High Tensile) and MT (Mega Tensile) grades, the use of high mechanical strengths potentially allowing improved reinforcement of the matrix in which the reinforcing element is intended to be embedded and lightening of the matrix reinforced in this way.

In one preferred embodiment, each elementary metallic monofilament has a diameter ranging from 0.05 mm to 0.50 mm, preferably from 0.10 mm to 0.48 mm, and more preferably from 0.15 mm to 0.45 mm.

In a first embodiment for partial reassembly of the M' metal filamentary elements, the separation step and the reassembly step are performed such that $M1'+M2'<M'$.

In first and second variants of the first embodiment, the step of separating the transitory assembly into at least the first split assembly, the second split assembly and the transitory core or one or more ensembles comprising the transitory core comprises, upstream of the reassembly step:

a step of separating the transitory assembly into:

a precursor ensemble comprising at least one layer made up of $M1''>1$ helically wound metal filamentary elements, the M1" metal filamentary elements originating from the layer made up of $M'>1$ metal filamentary elements of the transitory assembly, the second split assembly, and the transitory core or one or more ensembles comprising the transitory core, preferably the transitory core a step of separating the precursor ensemble into:

a main ensemble comprising at least one layer made up of $M3\geq1$ helically wound metal filamentary element(s), the $M3\geq1$ metal filamentary element(s) originating from the layer made up of the $M1''>1$ metal filamentary elements of the precursor ensemble, the main ensemble forming the first split assembly, and an additional ensemble comprising at least one layer made up of $M3'\geq1$ helically wound metal filamentary element(s), the $M3'\geq1$ metal filamentary element(s) originating from the layer made up of the $M1''>1$ metal filamentary elements of the precursor ensemble.

In these first and second variants of the first embodiment, $M'>M1''+M2'$, $M1''\geq M3+M3'$ and $M1'=M3$.

Preferably, in one embodiment making it possible to manufacture a final assembly consisting of a layer of metal filamentary elements, the precursor ensemble consists of a layer made up of the M1" helically wound metal filamentary elements, the main ensemble consists of a layer made up of the M3 helically wound metal filamentary element(s) and the additional ensemble consists of a layer made up of the M3' helically wound metal filamentary element(s).

In these first and second variant embodiments, the step of separating the transitory assembly into the precursor ensemble, the second split assembly and the transitory core or one or more ensembles comprising the transitory core, preferably the transitory core, takes place upstream of the step of separating the precursor ensemble into the main and additional ensembles.

Advantageously, the step of separating the precursor ensemble into the main ensemble forming the first split assembly and the additional ensemble comprises a step of splitting the precursor ensemble into:

the main ensemble forming the first split assembly, and the additional ensemble.

Thus, advantageously, $M1''=M3+M3'$ and $M3=M1'$.

In a first variant of the first embodiment in which the transitory core is separated from the first split assembly, the step of separating the transitory assembly into the precursor ensemble, the second split assembly and the transitory core or one or more ensembles comprising the transitory core, preferably the transitory core, comprises:

a step of separating the transitory assembly into:

a split ensemble comprising at least one layer made up of $M4'>1$ metal filamentary elements helically wound around the transitory core, the M4' metal filamentary elements originating from the layer made up of M' metal filamentary elements of the transitory assembly, and the second split assembly, a step of separating the split ensemble into:

the precursor ensemble, and the transitory core or one or more ensembles comprising the transitory core, preferably the transitory core.

Thus, in the first variant of the first embodiment, advantageously, $M'\geq M4'+M2'$ and $M4'\geq M1''$.

In this first variant, the split ensemble comprises the layer formed by the M4' metal filamentary elements and the transitory core, the M4' metal filamentary elements being helically wound around the transitory core. Preferably, in one embodiment making it possible to manufacture a final assembly consisting of a layer of metal filamentary elements, the split assembly consists of the layer constituted by the M4' metal filamentary elements and of the transitory core, the M4' metal filamentary elements being helically wound around the transitory core.

In this first variant, the step of separating the split ensemble into the precursor ensemble and the transitory core or one or more ensembles comprising the transitory core, preferably the transitory core, takes place upstream of the step of separating the precursor ensemble into the main and additional ensembles.

Advantageously, in this first variant, the step of separating the transitory assembly into the split ensemble and the second split assembly comprises a step of splitting the transitory assembly into:

the split ensemble, and the second split assembly.

Thus, advantageously, M'=M4'+M2'.

Advantageously, in this first variant, the step of separating the split ensemble into the precursor ensemble and the transitory core or one or more ensembles comprising the transitory core, preferably the transitory core, comprises a step of splitting the spilt ensemble into:

the precursor ensemble, and the transitory core or one or more ensembles comprising the transitory core, preferably the transitory core.

Thus, advantageously, M4'=M1" in the case of a step of splitting the split ensemble into the precursor ensemble and the transitory core.

In a second variant of the first embodiment in which the transitory core is separated from the second split assembly, the step of separating the transitory assembly into the precursor ensemble, the second split assembly and the transitory core or one or more ensembles comprising the transitory core, preferably the transitory core, comprises:

a step of separating the transitory assembly into:

a split ensemble comprising at least one layer made up of M4'>1 metal filamentary elements helically wound around the transitory core, the M4' metal filamentary elements originating from the layer made up of M'>1 metal filamentary elements of the transitory assembly, and the precursor ensemble, and a step of separating the split ensemble into:

the second split assembly, and the transitory core or one or more ensembles comprising the transitory core, preferably the transitory core.

Thus, in the second variant of the first embodiment, advantageously, M'≥M4'+M1" and M4≥M2'.

As in the first variant, in this second variant, the split ensemble comprises the layer formed by the M4' metal filamentary elements and the transitory core, the M4' metal filamentary elements being helically wound around the transitory core. Preferably, in one embodiment making it possible to manufacture a final assembly consisting of a layer of metal filamentary elements, the split assembly consists of the layer constituted by the M4' metal filamentary elements and of the transitory core, the M4' metal filamentary elements being helically wound around the transitory core.

In this second variant, the step of separating the transitory assembly into the split ensemble and the precursor ensemble takes place upstream of the step of separating the split ensemble into the second split assembly and the transitory core or one or more ensembles comprising the transitory core, preferably the transitory core.

Advantageously, in this second variant, the step of separating the transitory assembly into the split ensemble and the precursor ensemble comprises a step of splitting the transitory assembly into:

the split ensemble, and the precursor ensemble.

Thus, advantageously, M'=M4'+M1".

Advantageously, in this second variant, the step of separating the split ensemble into the second split assembly and the transitory core or one or more ensembles comprising the transitory core, preferably the transitory core, comprises a step of splitting the spilt ensemble into:

the second split assembly, and the transitory core or one or more ensembles comprising the transitory core, preferably the transitory core.

Thus, advantageously, M4'=M2' in the case of a step of splitting the split ensemble into the second split assembly and the transitory core.

In a third variant of the first embodiment in which the transitory core is separated from the first split assembly, the step of separating the transitory assembly into at least the first split assembly, the second split assembly and the transitory core or one or more ensembles comprising the transitory core comprises, upstream of the reassembly step:

a step of separating the transitory assembly into:

a split ensemble comprising at least one layer made up of M4'>1 metal filamentary elements helically wound around the transitory core, the M4' metal filamentary elements originating from the layer made up of M' metal filamentary elements of the transitory assembly, and the second split assembly.

a step of separating the split ensemble into:

the first split assembly, and the transitory core or one or more ensembles comprising the transitory core, preferably the transitory core.

In this third variant of the first embodiment, M'≥M4'+M2' and M4≥M1'.

As in the first and second variants, in this third variant, the split ensemble comprises the layer constituted by the M4' metal filamentary elements and the transitory core, the M4' metal filamentary elements being helically wound around the transitory core. Preferably, in one embodiment making it possible to manufacture a final assembly consisting of a layer of metal filamentary elements, the split assembly consists of the layer constituted by the M4' metal filamentary elements and of the transitory core, the M4' metal filamentary elements being helically wound around the transitory core.

In this third variant, the step of separating the transitory assembly into the split ensemble and the second split assembly takes place upstream of the step of separating the split ensemble into the first split assembly and the transitory core or one or more ensembles comprising the transitory core, preferably the transitory core.

Advantageously, in this third variant, the step of separating the transitory assembly into the split ensemble and the second split assembly comprises a step of splitting the transitory assembly into:

the split ensemble, and the second split assembly.

Thus, advantageously, M'=M4'+M2'.

Advantageously, the step of separating the split ensemble into the first split assembly and the transitory core or one or more ensembles comprising the transitory core, preferably the transitory core, comprises a step of separating the spilt ensemble into:

a main ensemble comprising at least one layer made up of M3≥1 helically wound metal filamentary element(s), the M3≥1 metal filamentary element(s) originating from the layer made up of the M4'>1 metal filamentary elements of the split ensemble, the main ensemble forming the first split assembly, an additional ensemble comprising at least one layer made up of M3'≥1 helically wound metal filamentary element(s), the M3'≥1 metal filamentary element(s) originating from the layer made up of the M4'>1 metal filamentary elements of the split ensemble, and the transitory core or one or more ensembles comprising the transitory core, preferably the transitory core.

Thus, in the third variant of the first embodiment, advantageously M4≥M3+M3' and M3=M1'.

Preferably, in one embodiment making it possible to manufacture a final assembly consisting of a layer of metal filamentary elements, the main ensemble consists of a layer consisting of the M3 helically wound metal filamentary element(s) and the additional ensemble consists of a layer consisting of the M3' helically wound metal filamentary element(s).

Advantageously, the step of separating the split ensemble into the main ensemble forming the first split assembly, the additional ensemble and the transitory core or one or more ensembles comprising the transitory core, preferably the transitory core, comprises:

a step of separating the split ensemble into:

the main ensemble forming the first split assembly, a derived ensemble comprising at least one layer made up of M5'≥1 metal filamentary element(s) helically wound around the transitory core, the M5'≥1 metal filamentary element(s) originating from the layer made up of the M4'>1 metal filamentary elements of the split ensemble, a step of separating the derived ensemble into:

the additional ensemble, the transitory core or one or more ensembles comprising the transitory core, preferably the transitory core.

Thus, in the third variant of the first embodiment, advantageously M4≥M3+M5', M3=M1' and M5≥M3'.

Preferably, the derived ensemble comprises the layer made up of the M5'≥1 wound metal filamentary element(s) and the transitory core, the M5' metal filamentary element(s) being helically wound around the transitory core. Preferably, in one embodiment making it possible to manufacture a final assembly made up of a layer of metal filamentary elements, the derived ensemble consists of the layer made up of the M5'≥1 wound metal filamentary element(s) and of the transitory core, the M5' metal filamentary element(s) being helically wound around the transitory core.

In this third variant, the step of separating the split ensemble into the main ensemble and the derived ensemble takes place upstream of the step of separating the derived ensemble into the additional ensemble and the transitory core or one or more ensembles comprising the transitory core, preferably the transitory core.

Advantageously, in this third variant, the step of separating the split ensemble into the main ensemble forming the first split assembly and the derived ensemble comprises a step of splitting the split ensemble into:

the main ensemble forming the first split assembly, and the derived ensemble.

Thus, advantageously, M4'=M3+M5' and M3=M1'.

Advantageously, in this third variant, the step of separating the derived ensemble into the additional ensemble and the transitory core or one or more ensembles comprising the transitory core, preferably the transitory core, comprises a step of splitting the derived ensemble into:

the additional ensemble, and the transitory core or one or more ensembles comprising the transitory core, preferably the transitory core.

Thus, advantageously, M5'=M3' in the case of a step of splitting the derived ensemble into the additional ensemble and the transitory core.

In a fourth variant of the first embodiment in which the first split assembly, the second split assembly and the transitory core are separated simultaneously, the step of separating the transitory assembly into at least the first split assembly, the second split assembly and the transitory core or one or more ensembles comprising the transitory core comprises, upstream of the reassembly step, a step of splitting the transitory assembly into:

the first split assembly, the second split assembly, the transitory core or one or more ensembles comprising the transitory core, preferably the transitory core, and a split ensemble comprising at least one layer made up of M4'≥1 helically wound metal filamentary element(s), the M4' metal filamentary element(s) originating from the layer made up of M' metal filamentary elements of the transitory assembly.

Preferably, in one embodiment for manufacturing a final assembly made up of a layer of metal filamentary elements, the split ensemble consists of the layer made up of the M4' metal filamentary element(s).

In a configuration of the first embodiment in which the transitory core is separated into two parts each with the first and second split assemblies, the step of separating the transitory assembly into at least the first split assembly, the second split assembly and the transitory core or one or more ensembles comprising the transitory core comprises, upstream of the reassembly step:

a step of separating the transitory assembly into:

a first split ensemble comprising at least one layer made up of M6'>1 metal filamentary elements helically wound around a first part of the transitory core, the M6'>1 metal filamentary elements originating from the layer made up of the M' metal filamentary elements of the transitory assembly, and a second split ensemble comprising at least one layer made up of M7'>1 metal filamentary elements helically wound around a second part of the transitory core, the M7'>1 metal filamentary elements originating from the layer made up of the M' metal filamentary elements of the transitory assembly, the first part of the transitory core and the second part of the transitory core constituting, prior to the step of separating the transitory assembly, the transitory core, a step of separating the first split ensemble into:

the first split assembly, the first part of the transitory core or one or more ensembles comprising the first part of the transitory core, preferably the first part of the transitory core a step of separating the second split ensemble into:

the second split assembly, and the second part of the transitory core or one or more ensembles comprising the second part of the transitory core, preferably the second part of the transitory core.

In this configuration of the first embodiment, M'≥M6'+M7', M6'>M1' and M7≥M2'.

In this configuration of the first embodiment, the first split ensemble comprises the layer made up of the M6' metal filamentary elements and the first part of the transitory core, the M6' metal filamentary elements being helically wound around the first part of the transitory core. Preferably, in one embodiment making it possible to manufacture a final assembly consisting of a layer of metal filamentary elements, the first split ensemble consists of the layer constituted by the M6' metal filamentary elements and of the first part of the transitory core, the M6' metal filamentary elements being helically wound around the first part of the transitory core.

Analogously, in this configuration of the first embodiment, the second split ensemble comprises the layer made up of the M7' metal filamentary elements and the second part of the transitory core, the M7' metal filamentary elements being helically wound around the second part of the transitory core. Preferably, in one embodiment making it possible to manufacture a final assembly consisting of a layer of metal filamentary elements, the second split ensemble consists of the layer constituted by the M7' metal filamentary elements and of the second part of the transitory core, the M7' metal filamentary elements being helically wound around the second part of the transitory core.

In this configuration of the first embodiment, the step of separating the transitory assembly into the first split ensemble and the second split ensemble takes place upstream of the step of separating the first split ensemble into the first split assembly and the first part of the transitory core or one or more ensembles comprising the first part of the transitory core, preferably the first part of the transitory core.

In this configuration of the first embodiment, the step of separating the transitory assembly into the first split ensemble and the second split ensemble takes place upstream of the step of separating the second split ensemble into the second split assembly and the second part of the transitory core or one or more ensembles comprising the second part of the transitory core, preferably the second part of the transitory core.

Advantageously, in this configuration of the first embodiment, the step of separating the transitory assembly into the first split ensemble and the second split ensemble comprises a step of splitting the transitory assembly into:

the first split ensemble, and the second split ensemble.

Thus, advantageously, M'=M6'+M7'.

Advantageously, in this configuration of the first embodiment, the step of separating the second split ensemble into the second split assembly and the second part of the transitory core or one or more ensembles comprising the second part of the transitory core, preferably the second part of the transitory core, comprises a step of splitting the second split ensemble into:

the second split assembly, and the second part of the transitory core or one or more ensembles comprising the second part of the transitory core, preferably the second part of the transitory core.

Thus, advantageously, M7'=M2'.

Advantageously, in this configuration of the first embodiment in which the transitory core is separated into two parts each with the first and second split assemblies, the step of separating the first split ensemble into the first split assembly and the first part of the transitory core or one or more ensembles comprising the first part of the transitory core, preferably the first part of the transitory core, comprises a step of separating the first split ensemble into:

a main ensemble comprising at least one layer made up of M3≥1 helically wound metal filamentary element(s), the M3≥1 metal filamentary element(s) originating from the layer made up of the M6'>1 metal filamentary elements of the first split ensemble, the main ensemble forming the first split assembly, an additional ensemble comprising at least one layer made up of M3'≥1 helically wound metal filamentary element(s), the M3'≥1 metal filamentary element(s) originating from the layer made up of the M6'>1 metal filamentary elements of the first split ensemble, and the first part of the transitory core or one or more ensembles comprising the first part of the transitory core, preferably the first part of the transitory core.

In this configuration of the first embodiment in which the transitory core is separated into two parts each with the first and second split assemblies, advantageously, M6'≥M3+M3' and M3=M1'.

Preferably, in one embodiment making it possible to manufacture a final assembly consisting of a layer of metal filamentary elements, the main ensemble consists of a layer consisting of the M3 helically wound metal filamentary element(s) and the additional ensemble consists of a layer consisting of the M3' helically wound metal filamentary element(s).

In a first variant of this configuration of the first embodiment in which the transitory core is separated into two parts each with the first and second split assemblies, the step of separating the first split ensemble into the main ensemble forming the first split assembly, the additional ensemble and the first part of the transitory core or one or more ensembles comprising the first part of the transitory core, preferably the first part of the transitory core, comprises:

a step of separating the first split ensemble into:

a precursor ensemble comprising at least one layer made up of M1">1 helically wound metal filamentary elements, the M1" metal filamentary elements originating from the layer made up of M6'>1 metal filamentary elements of the first split ensemble, the first part of the transitory core or one or more ensembles comprising the first part of the transitory core, preferably the first part of the transitory core, a step of separating the precursor ensemble into:

the main ensemble forming the first split assembly and the additional ensemble.

In this first variant of the configuration of the first embodiment in which the transitory core is separated into two parts each with the first and second split assemblies, M6'≥M1", M1"≥M3+M3' and M3=M1'.

Preferably, in one embodiment making it possible to manufacture a final assembly made up of a layer of metal filamentary elements, the precursor ensemble consists of a layer made up of M1" helically wound metal filamentary elements.

In this first variant of this configuration of the first embodiment, the step of separating the first split ensemble into the precursor ensemble and the first part of the transitory core or one or more ensembles comprising the first part of the transitory core, preferably the first part of the transitory core, takes place upstream of the step of separating the precursor ensemble into the main ensemble forming the first split assembly and the additional ensemble.

Advantageously, in this first variant of this configuration of the first embodiment, the step of separating the first split ensemble into the precursor ensemble and the first part of the transitory core or one or more ensembles comprising the first part of the transitory core, preferably the first part of the transitory core, comprises a step of splitting the first split ensemble into:

the precursor ensemble, and the first part of the transitory core or one or more ensembles comprising the first part of the transitory core, preferably the first part of the transitory core.

Thus, advantageously, M6'=M1" in the case of a step of splitting the first split ensemble into the precursor ensemble and the first part of the transitory core.

Advantageously, in this first variant of this configuration of the first embodiment, the step of separating the precursor ensemble into the main ensemble forming the first split assembly and the additional ensemble comprises a step of splitting the precursor ensemble into:

the main ensemble forming the first split assembly, and the additional ensemble.

Thus, advantageously, M1"=M3+M3' and M3=M1'.

In a second variant of this configuration of the first embodiment in which the transitory core is separated into two parts each with the first and second split assemblies, the step of separating the first split ensemble into the main ensemble forming the first split assembly, the additional ensemble and the first part of the transitory core or one or more ensembles comprising the first part of the transitory core, preferably the first part of the transitory core, comprises:

a step of separating the first split ensemble into:

the main ensemble forming the first split assembly, a derived ensemble comprising at least one layer made up of M5'≥1 metal filamentary element(s) helically wound around the first part of the transitory core, the M5'≥1 metal filamentary element(s) originating from the layer made up of the M6'>1 metal filamentary elements of the first split ensemble, a step of separating the derived ensemble into:

the additional ensemble, the first part of the transitory core or one or more ensembles comprising the transitory core, preferably the first part of the transitory core.

In this second variant of the configuration of the first embodiment in which the transitory core is separated into two parts each with the first and second split assemblies, M6≥M3+M5', M5'≥M3' and M3=M1'.

In this second variant of this configuration of the first embodiment, the derived ensemble comprises the layer made up of the M5'≥1 metal filamentary element(s) and the first part of the transitory core, the M5'≥1 metal filamentary element(s) being helically wound around the first part of the transitory core. Preferably, in one embodiment making it possible to manufacture a final assembly made up of a layer of metal filamentary elements, the derived ensemble consists of the layer made up of the M5'≥1 metal filamentary element(s) and the first part of the transitory core, the M5'≥1 metal filamentary element(s) being helically wound around the first part of the transitory core.

In this second variant of this configuration of the first embodiment, the step of separating the first split ensemble into the main ensemble and the derived ensemble takes place upstream of the step of separating the derived ensemble into the additional ensemble and the first part of the transitory core or one or more ensembles comprising the first part of the transitory core, preferably the first part of the transitory core.

Advantageously, in this second variant of this configuration of the first embodiment, the step of separating the first split ensemble into the main ensemble forming the first split assembly and the derived ensemble comprises a step of splitting the first split ensemble into:

the main ensemble forming the first split assembly, and the derived ensemble.

Thus, advantageously, M6'=M3+M5' and M3=M1'.

Advantageously, in this second variant of this configuration of the first embodiment, the step of separating the derived ensemble into the additional ensemble and the first part of the transitory core or one or more ensembles comprising the transitory core, preferably the first part of the transitory core, comprises a step of splitting the derived ensemble into:

the additional ensemble, and the first part of the transitory core or one or more ensembles comprising the transitory core, preferably the first part of the transitory core.

Thus, advantageously, M5'=M3' in the case of a step of splitting the derived ensemble into the additional ensemble and the first part of the transitory core.

In another configuration of the first embodiment in which the transitory core is separated into two parts, the step of separating the transitory assembly into at least the first split assembly, the second split assembly and the transitory core or one or more ensembles comprising the transitory core comprises, upstream of the reassembly step, a step of splitting the transitory assembly into:

the first split assembly, the second split assembly, a first part of the transitory core, a second part of the transitory core, the first part of the transitory core and the second part of the transitory core constituting, prior to the step of separating the transitory assembly, the transitory core, a split ensemble comprising at least one layer made up of M4'≥1 helically wound metal filamentary element(s), the M4' metal filamentary element(s) originating from the layer made up of M' metal filamentary elements of the transitory assembly.

Preferably, in one embodiment for manufacturing a final assembly made up of a layer of metal filamentary elements, the split ensemble consists of the layer made up of the M4' metal filamentary element(s).

In a second embodiment for total reassembly of the M' metal filamentary elements, the separation step and the reassembly step are performed such that M1'+M2'=M'.

In a first variant of the second embodiment in which the transitory core is separated from the first split assembly, the step of separating the transitory assembly into at least the first split assembly, the second split assembly and the transitory core or one or more ensembles comprising the transitory core comprises, upstream of the reassembly step:

a step of separating the transitory assembly into:

a split ensemble comprising at least one layer made up of M4'≥1 metal filamentary element(s) helically wound around the transitory core, the M4'≥1 metal filamentary element(s) originating from the layer made up of the M'>1 metal filamentary elements of the transitory assembly and the second split assembly, a step of separating the split ensemble into:
the first split assembly, and
the transitory core.

In this first variant of the second embodiment, M'=M4'+M2' and M4'=M1'.

In this first variant of the second embodiment, the split assembly comprises the layer formed by the M4' metal filamentary element(s) and the transitory core, the M4' metal filamentary elements(s) being helically wound around the transitory core. Preferably, the split ensemble consists of the layer formed by the M4' metal filamentary element(s) and of the transitory core, the M4' metal filamentary element(s) being helically wound around the transitory core.

In this first variant of the second embodiment, the step of separating the transitory assembly into the split ensemble and the second split assembly takes place upstream of the step of separating the split ensemble into the first split assembly and the transitory core or one or more ensembles comprising the transitory core, preferably the transitory core.

Advantageously, in this first variant of the second embodiment, the step of separating the transitory assembly into the split ensemble and the second split assembly comprises a step of splitting the transitory assembly into:
the split ensemble and
the second split assembly.

Advantageously, in this first variant of the second embodiment, the step of separating the split ensemble into the first split assembly and the transitory core or one or more ensembles comprising the transitory core, preferably the transitory core, comprises a step of splitting the spilt ensemble into:
the first split assembly, and
the transitory core.

In a second variant of the second embodiment in which the transitory core is separated from the second split assembly, the step of separating the transitory assembly into at least the first split assembly, the second split assembly and the transitory core or one or more ensembles comprising the transitory core comprises, upstream of the reassembly step:
a step of separating the transitory assembly into:
a split ensemble comprising at least one layer made up of M4'>1 metal filamentary elements helically wound around the transitory core, the M4'>1 metal filamentary elements originating from the layer made up of the M'>1 metal filamentary elements of the transitory assembly, and
the first split assembly
a step of separating the split ensemble into:
the second split assembly, and
the transitory core.

In this second variant of the second embodiment, M'=M4'+M1' and M4'=M2'.

As in the first variant, in this second variant of the second embodiment, the split ensemble comprises the layer constituted by the M4' metal filamentary elements and the transitory core, the M4' metal filamentary elements being helically wound around the transitory core. Preferably, the split ensemble consists of the layer formed by the M4' metal filamentary elements and of the transitory core, the metal filamentary elements being helically wound around the transitory core.

In this second variant of the second embodiment, the step of separating the transitory assembly into the split ensemble and the first split assembly takes place upstream of the step of separating the split ensemble into the second split assembly and the transitory core or one or more ensembles comprising the transitory core, preferably the transitory core.

Advantageously, in this second variant of the second embodiment, the step of separating the transitory assembly into the split ensemble and the first split assembly comprises a step of splitting the transitory assembly into:
the split ensemble, and
the first split assembly.

Advantageously, in this second variant of the second embodiment, the step of separating the split ensemble into the second split assembly and the transitory core or one or more ensembles comprising the transitory core, preferably the transitory core, comprises a step of splitting the spilt ensemble into:
the second split assembly, and
the transitory core or one or more ensembles comprising the transitory core, preferably the transitory core.

In a third variant of the second embodiment in which the transitory core is separated into two parts each with the first and second split assemblies, the step of separating the transitory assembly into at least the first split assembly, the second split assembly and the transitory core or one or more ensembles comprising the transitory core comprises, upstream of the reassembly step:
a step of separating the transitory assembly into:
a first split ensemble comprising at least one layer made up of M6'≥1 metal filamentary element(s) helically wound around a first part of the transitory core, the M6'≥1 metal filamentary element(s) originating from the layer made up of the M' metal filamentary elements of the transitory assembly, and
a second split ensemble comprising at least one layer made up of M7'>1 metal filamentary elements helically wound around a second part of the transitory core, the M7'>1 metal filamentary elements originating from the layer made up of the M' metal filamentary elements of the transitory assembly,
the first part of the transitory core and the second part of the transitory core constituting, prior to the step of separating the transitory assembly, the transitory core,
a step of separating the first split ensemble into:
the first split assembly, and
the first part of the transitory core,
a step of separating the second split ensemble into:
the second split assembly, and
the second part of the transitory core.

In this third variant of the second embodiment, M'=M6'+M7', M6'=M1' and M7'=M2'.

In this third variant of the second embodiment, the first split ensemble comprises the layer constituted by the M6' metal filamentary element(s) and the first part of the transitory core, the M6' metal filamentary element(s) being helically wound around the first part of the transitory core. Preferably, the first split ensemble consists of the layer made up of the M6' metal filamentary element(s) and of the first part of the transitory core, the M6' metal filamentary element(s) being helically wound around the first part of the transitory core.

Analogously, in this third variant, the second split ensemble comprises the layer constituted by the M7' metal filamentary elements and the second part of the transitory core, the M7' metal filamentary elements being helically wound around the second part of the transitory core. Preferably, the second split ensemble consists of the layer consisting of the M7' metal filamentary elements and the second part of the transitory core, the M7' metal filamentary elements being helically wound around the second part of the transitory core.

In this third variant of the second embodiment, the step of separating the transitory assembly into the first split ensemble and the second split ensemble takes place upstream of the step of separating the first split ensemble into the first split assembly and the first part of the transitory core.

In this configuration of the second embodiment, the step of separating the transitory assembly into the first split ensemble and the second split ensemble takes place upstream of the step of separating the second split ensemble into the second split assembly and the second part of the transitory core.

Advantageously, in this third variant of the second embodiment, the step of separating the transitory assembly into the first split ensemble and the second split ensemble comprises a step of splitting the transitory assembly into:

the first split ensemble, and the second split ensemble.

Advantageously, in this third variant of the second embodiment, the step of separating the first split ensemble into the first split assembly and the first part of the transitory core comprises a step of splitting the first split ensemble into:

the first split assembly, and the first part of the transitory core.

Advantageously, in this third variant of the second embodiment, the step of separating the second split ensemble into the second split assembly and the second part of the transitory core comprises a step of splitting the second split ensemble into:

the second split assembly, and the second part of the transitory core.

In a fourth variant of the second embodiment in which the first split assembly, the second split assembly and the transitory core are separated simultaneously, the step of separating the transitory assembly into at least the first split assembly, the second split assembly and the transitory core comprises, upstream of the reassembly step, a step of splitting the transitory assembly into:

the first split assembly, the second split assembly, and the transitory core.

In a fifth variant of the second embodiment in which the transitory core is separated into two parts, the step of separating the transitory assembly into at least the first split assembly, the second split assembly and the transitory core comprises, upstream of the reassembly step, a step of splitting the transitory assembly into:

the first split assembly, the second split assembly, a first part of the transitory core, a second part of the transitory core, the first part of the transitory core and the second part of the transitory core constituting, prior to the step of separating the transitory assembly, the transitory core.

In a particularly preferred embodiment, the final assembly consisting of the layer consisting of N' helically wound metal filamentary elements, the method comprises:

a step of providing a transitory assembly made up of the layer made up of M'>1 metal filamentary elements helically wound around the transitory core, a step of separating the transitory assembly into at least:

the first split assembly made up of the layer consisting of M1'≥1 helically wound metal filamentary element(s), the M1' metal filamentary element(s) originating from the layer made up of M'>1 metal filamentary elements of the transitory assembly, the second split assembly made up of the layer made up of M2'>1 helically wound metal filamentary elements, the M2' metal filamentary elements originating from the layer made up of M'>1 metal filamentary elements of the transitory assembly, and the transitory core or one or more ensembles comprising the transitory core, preferably the transitory core.

In this particularly preferred embodiment, the final assembly consists of a single layer of N'>1 helically wound metal filamentary elements and therefore has no central core around which the N' metal filamentary elements would be wound. This is also referred to as a final assembly with a 1×N' structure or even a final assembly with an open structure ("open-cord").

Advantageously, M' ranges from 4 to 18, and preferably from 6 to 9.

Advantageously, to facilitate the extraction of the transitory core in the embodiments in which the transitory core is separated from the first split assembly:

M1'=1 or 2 in instances in which M'=4 or M'=5 and

M1'≤0.75×M' and preferably M1'≤0.70×M' in instances in which M'≥6.

Advantageously, and similarly, to facilitate the extraction of the transitory core in the embodiments in which the transitory core is separated from the second split assembly:

M2'=1 or 2 in instances in which M'=4 or M'=5 and

M2'≤0.75×M' and preferably M2'≤0.70×M' in instances in which M'≥6.

Advantageously, and similarly, to facilitate the extraction of the transitory core in the embodiments in which the transitory core is separated into two parts each with the first and second split assemblies:

M1'=1, 2 or 3 and M2'=1, 2 or 3 in instances in which M'=4 or M'=5 and

M1'≤0.75×M' in instances in which M'≥6.

M2'≤0.75×M' in instances in which M'≥6.

To further facilitate the extraction of the transitory core in the embodiments in which the transitory core is separated into two parts each with the first and second assemblies in instances in which M'≥6, M1'≤0.70×M' and M2'≤0.70×M'.

Highly preferably, the step of supplying the transitory assembly comprises a step of assembling, by twisting, the M'>1 metal filamentary elements helically wound around the transitory core.

Advantageously, the step of supplying the transitory assembly comprises a step of balancing the transitory assembly. Thus, since the balancing step is performed on the transitory assembly comprising the M' metal filamentary elements and the transitory core, the balancing step is implicitly performed upstream of the step of separation into the first and second split assemblies. This avoids the need to manage the residual twist imposed during the step of assembling the transitory assembly in the path followed by the various assemblies downstream of the assembly step, notably through the guide means, for example the pulleys.

Advantageously, the method comprises a step of balancing the final assembly downstream of the reassembly step.

Advantageously, the method comprises a step of maintaining the rotation of the final assembly around its direction of travel. This rotation maintenance step is carried out downstream of the step of separating the transitory assembly and upstream of the step of balancing the final assembly.

As a preference, the method does not have steps of individually preforming each of the metal filamentary elements. In the methods of the prior art employing a step of individually preforming each of the metal filamentary elements, these elements receive a shape imposed by preforming tools, for example rollers, these tools creating defects on the surface of the metal filamentary elements. These defects notably lower the endurance of the metal filamentary elements and therefore of the final assembly.

Very preferably, the transitory core is a metal filamentary element. In a preferred embodiment, the transitory core is a metallic monofilament. Thus, the diameter of the space between the metal filamentary elements and therefore the geometric characteristics of the final assembly are very precisely controlled, by contrast with a transitory core that is made of a textile, for example polymer material, the compressibility of which may lead to variations in the geometric characteristics of the final assembly.

In other equally advantageous embodiments, the transitory core is a textile filamentary element. Such a textile filamentary element comprises at least one multifilament textile strand or, as a variant, is made up of a textile monofilament. The textile filaments that can be used are selected from polyesters, polyketones, aliphatic or aromatic polyamides and mixtures of textile filaments made of these materials. This then reduces the risks of breakage of the transitory core which are brought about by the rubbing of the metal filamentary elements against the transitory core and by the torsion imposed on the transitory core.

An object obtained by a method according to the invention is a final assembly of metal filamentary elements obtained by the method as defined above.

Another object obtained by a method according to the invention is a tyre comprising a final assembly as defined above.

Such a tyre is notably intended to equip motor vehicles of passenger type, SUVs (Sport Utility Vehicles), two-wheel vehicles (in particular bicycles and motorcycles), aircraft, and industrial vehicles chosen from vans, heavy-duty vehicles, that is to say underground trains, buses, heavy road transport vehicles (lorries, tractors, trailers) or off-road vehicles, such as agricultural vehicles or civil engineering vehicles, and other transportation or handling vehicles.

Advantageously, the tyre comprises a crown comprising a tread and a crown reinforcement, the tyre comprising two sidewalls, two beads, each sidewall connecting each bead to the crown, the crown reinforcement extending in the crown in a circumferential direction of the tyre, the tyre comprising a carcass reinforcement that is anchored in each of the beads and extends in the sidewalls and in the crown, the crown reinforcement being radially interposed between the carcass reinforcement and the tread. In one embodiment, the crown reinforcement comprises a final assembly as defined hereinabove.

The subject of the invention is also an installation for manufacturing a final assembly comprising at least one layer consisting of N'>1 helically wound metal filamentary elements, the installation comprising:

means for supplying a transitory assembly comprising at least one layer made up of M'>1 metal filamentary elements helically wound around a transitory core, means for separating the transitory assembly into at least:

a first split assembly comprising at least one layer made up of M1'≥1 helically wound metal filamentary element(s), the M1' metal filamentary element(s) originating from the layer made up of M'>1 metal filamentary elements of the transitory assembly, a second split assembly comprising at least one layer made up of M2'≥1 helically wound metal filamentary elements, the M2' metal filamentary elements originating from the layer made up of M'>1 metal filamentary elements of the transitory assembly, the transitory core or one or more ensembles comprising the transitory core, the installation comprising means for reassembling at least the first split assembly with the second split assembly to form the layer consisting of N' helically wound metal filamentary elements.

In order to make it possible in an advantageous embodiment to obtain an assembly in which the metal filamentary elements have identical geometric characteristics, the supply means, the separation means and the reassembly means are arranged so that all the N' metal filamentary elements have the same diameter d, are helically wound at the same pitch p and have the same helix diameter $\phi$.

Furthermore, as described above, according to the various embodiments, the separation step and the reassembly step are carried out in such a way that M'≥M1'+M2'=N'.

In the present invention, means for splitting an initial object into several final objects mean that, by implementing these splitting means, the initial object is divided into the final objects and only these final objects so that the entirety of the initial object goes on to form part of the final objects. In addition, by using splitting means, the initial object is divided into the final objects simultaneously, which is to say that the final objects are separated off at the one same splitting point. In particular, in the case of an initial object that is split into at least three final objects, the three final objects are, using splitting means, separated from one another simultaneously and at the one same point.

In the present invention, means for separating an initial object into several final objects means that, in order to obtain these final objects, at least splitting means are required. Thus, in order to obtain the final objects, the separation means comprise means for splitting the initial object into the final objects or else comprise means for splitting the initial object into intermediate objects, and means for splitting the intermediate objects into the final objects. In the use of the separation means, the initial object does not necessarily go on in its entirety to form the final objects, as ensembles or assemblies may have been extracted from the method during their passage through the splitting means and so not used in their passage through later splitting means. Finally, separation means may comprise means for reassembling several intermediate objects originating from splitting means of the separation means in order to obtain other intermediate objects or else the final objects.

In a first embodiment for partial reassembly of the M' metal filamentary elements, the separation means and the reassembly means are arranged such that M1'+M2'<M'.

In first and second variants of the first embodiment, the means for separating the transitory assembly into at least the first split assembly, the second split assembly and the transitory core or one or more ensembles comprising the transitory core comprise, upstream of the reassembly means:

means for separating the transitory assembly into:

a precursor ensemble comprising at least one layer made up of M1"≥1 helically wound metal filamentary elements, the M1" metal filamentary elements originating from the layer made up of M'>1 metal filamentary elements of the transitory assembly, the second split assembly, and the transitory core or one or more ensembles comprising the transitory core, preferably the transitory core, means for separating the precursor ensemble into:

a main ensemble comprising at least one layer made up of M3≥1 helically wound metal filamentary element(s), the M3≥1 metal filamentary element(s) originating from the layer made up of the M1">1 metal filamentary elements of the precursor ensemble, the main ensemble forming the first split assembly, and an additional ensemble comprising at least one layer made up of M3'1 helically wound metal filamentary element(s), the M3'≥1 metal filamentary element(s) originating from the layer made up of the M1">1 metal filamentary elements of the precursor ensemble.

In this first embodiment, the means for separating the transitory assembly into the precursor ensemble, the second split assembly and the transitory core or one or more ensembles comprising the transitory core, preferably the transitory core, are arranged upstream of the means for separating the precursor ensemble into the main and additional ensembles.

Advantageously, the means for separating the precursor ensemble into the main ensemble forming the first split assembly and the additional ensemble comprise means for splitting the precursor ensemble into:

the main ensemble forming the first split assembly, and the additional ensemble.

In a first variant of the first embodiment in which the transitory core is separated from the first split assembly, the means for separating the transitory assembly into the precursor ensemble, the second split assembly and the transitory core or one or more ensembles comprising the transitory core, preferably the transitory core, comprise:

means for separating the transitory assembly into:

a split ensemble comprising at least one layer made up of M4'>1 metal filamentary elements helically wound around the transitory core, the M4' metal filamentary elements originating from the layer made up of M' metal filamentary elements of the transitory assembly, and the second split assembly, means for separating the split ensemble into:

the precursor ensemble, and the transitory core or one or more ensembles comprising the transitory core, preferably the transitory core.

In this first variant, the means for separating the split ensemble into the precursor ensemble and the transitory core or one or more ensembles comprising the transitory core, preferably the transitory core, are arranged upstream of the means for separating the precursor ensemble into the main and additional ensembles.

Advantageously, in this first variant, the means for separating the transitory assembly into the split ensemble and the second split assembly comprise means for splitting the transitory assembly into:

the split ensemble, and the second split assembly.

Advantageously, in this first variant, the means for separating the split ensemble into the precursor ensemble and the transitory core or one or more ensembles comprising the transitory core, preferably the transitory core, comprise means for splitting the split ensemble into:

the precursor ensemble, and the transitory core or one or more ensembles comprising the transitory core, preferably the transitory core.

In a second variant of the first embodiment in which the transitory core is separated from the second split assembly, the means for separating the transitory assembly into the precursor ensemble, the second split assembly and the transitory core or one or more ensembles comprising the transitory core, preferably the transitory core, comprise:

means for separating the transitory assembly into:

a split ensemble comprising at least one layer made up of M4'>1 metal filamentary elements helically wound around the transitory core, the M4' metal filamentary elements originating from the layer made up of M'>1 metal filamentary elements of the transitory assembly, and the precursor ensemble, and means for separating the split ensemble into:

the second split assembly, and the transitory core or one or more ensembles comprising the transitory core, preferably the transitory core.

In this second variant, the means for separating the transitory assembly into the split ensemble and the precursor ensemble are arranged upstream of the means for separating the split ensemble into the second split assembly and the transitory core or one or more ensembles comprising the transitory core, preferably the transitory core.

Advantageously, in this second variant, the means for separating the transitory assembly into the split ensemble and the precursor ensemble comprise means for splitting the transitory assembly into:

the split ensemble, and the precursor ensemble.

Advantageously, in this second variant, the means for separating the split ensemble into the second split assembly and the transitory core or one or more ensembles comprising the transitory core, preferably the transitory core, comprise means for splitting the split ensemble into:

the second split assembly, and the transitory core or one or more ensembles comprising the transitory core, preferably the transitory core.

In a third variant of the first embodiment in which the transitory core is separated from the first split assembly, the means for separating the transitory assembly into at least the first split assembly, the second split assembly and the transitory core or one or more ensembles comprising the transitory core, preferably the transitory core, comprise, upstream of the reassembly means:

means for separating the transitory assembly into:

a split ensemble comprising at least one layer made up of M4'>1 metal filamentary elements helically wound around the transitory core, the M4' metal filamentary elements originating from the layer made up of M' metal filamentary elements of the transitory assembly, and the second split assembly.

means for separating the split ensemble into:

the first split assembly, and the transitory core or one or more ensembles comprising the transitory core, preferably the transitory core.

In this third variant, the means for separating the transitory assembly into the split ensemble and the second split assembly are arranged upstream of the means for separating the split ensemble into the first split assembly and the transitory core or one or more ensembles comprising the transitory core, preferably the transitory core.

Advantageously, in this third variant, the means for separating the transitory assembly into the split ensemble and the second split assembly comprise means for splitting the transitory assembly into:

the split ensemble, and the second split assembly.

Advantageously, the means for separating the split ensemble into the first split assembly and the transitory core or one or more ensembles comprising the transitory core, preferably the transitory core, comprise means for separating the split ensemble into:

a main ensemble comprising at least one layer made up of M3≥1 helically wound metal filamentary element(s), the M3≥1 metal filamentary element(s) originating from the layer made up of the M4'>1 metal filamentary elements of the split ensemble, the main ensemble forming the first split assembly, an additional ensemble comprising at least one layer made up of M3'≥1 helically wound metal filamentary element(s), the M3'≥1 metal filamentary element(s) originating from the layer made up of the M4'>1 metal filamentary elements of the split ensemble, and the transitory core or one or more ensembles comprising the transitory core, preferably the transitory core.

Advantageously, the means for separating the split ensemble into the main ensemble forming the first split assembly, the additional ensemble and the transitory core or one or more ensembles comprising the transitory core, preferably the transitory core, comprise:

means for separating the split ensemble into:

the main ensemble forming the first split assembly, a derived ensemble comprising at least one layer made up of M5'≥1 metal filamentary element(s) helically wound around a transitory core, the M5'≥1 metal filamentary element(s) originating from the layer made up of the M4'>1 metal filamentary elements of the split ensemble, means for separating the derived ensemble into:

the additional ensemble, the transitory core or one or more ensembles comprising the transitory core, preferably the transitory core.

In this third variant, the means for separating the split ensemble into the main ensemble and the derived ensemble are arranged upstream of the means for separating the derived ensemble into the additional ensemble and the transitory core or one or more ensembles comprising the transitory core, preferably the transitory core.

Advantageously, in this third variant, the means for separating the split ensemble into the main ensemble forming the first split assembly and the derived ensemble comprise means for splitting the split ensemble into:

the main ensemble forming the first split assembly, and the derived ensemble.

Advantageously, in this third variant, the means for separating the derived ensemble into the additional ensemble and the transitory core or one or more ensembles comprising the transitory core, preferably the transitory core, comprise means for splitting the derived ensemble into:

the additional ensemble, and the transitory core or one or more ensembles comprising the transitory core, preferably the transitory core.

In a fourth variant of the first embodiment in which the first split assembly, the second split assembly and the transitory core are separated simultaneously, the means for separating the transitory assembly into at least the first split assembly, the second split assembly and the transitory core or one or more ensembles comprising the transitory core comprise, upstream of the reassembly means, means for splitting the transitory assembly into:

the first split assembly, the second split assembly, the transitory core or one or more ensembles comprising the transitory core, preferably the transitory core, and a split ensemble comprising at least one layer made up of M4'≥1 helically wound metal filamentary element(s), the M4' metal filamentary element(s) originating from the layer made up of M' metal filamentary elements of the transitory assembly.

In a configuration of the first embodiment in which the transitory core is separated into two parts each with the first and second split assemblies, the means for separating the transitory assembly into at least the first split assembly, the second split assembly and the transitory core or one or more ensembles comprising the transitory core comprise, upstream of the reassembly means:

means for separating the transitory assembly into:

a first split ensemble comprising at least one layer made up of M6'>1 metal filamentary elements helically wound around a first part of the transitory core, the M6'>1 metal filamentary elements originating from the layer made up of the M' metal filamentary elements of the transitory assembly, and a second split ensemble comprising at least one layer made up of M7'>1 metal filamentary elements helically wound around a second part of the transitory core, the M7'>1 metal filamentary elements originating from the layer made up of the M' metal filamentary elements of the transitory assembly, the first part of the transitory core and the second part of the transitory core constituting, upstream of the means for separating the transitory assembly, the transitory core, means for separating the first split ensemble into:

the first split assembly, the first part of the transitory core or one or more ensembles comprising the first part of the transitory core, preferably the first part of the transitory core, means for separating the second split ensemble into:

the second split assembly, and the second part of the transitory core or one or more ensembles comprising the second part of the transitory core, preferably the second part of the transitory core.

In this configuration of the first embodiment, the means for separating the transitory assembly into the first split ensemble and the second split ensemble are arranged upstream of the means for separating the first split ensemble into the first split assembly and the first part of the transitory core or one or more ensembles comprising the first part of the transitory core, preferably the first part of the transitory core.

In this configuration of the first embodiment, the means for separating the transitory assembly into the first split ensemble and the second split ensemble are arranged upstream of the means for separating the second split ensemble into the second split assembly and the second part of the transitory core or one or more ensembles comprising the second part of the transitory core, preferably the second part of the transitory core.

Advantageously, in this configuration of the first embodiment, the means for separating the transitory assembly into the first split ensemble and the second split ensemble comprise means for splitting the transitory assembly into:

the first split ensemble, and the second split ensemble.

Advantageously, in this configuration of the first embodiment, the means for separating the second split ensemble into the second split assembly and the second part of the transitory core or one or more ensembles comprising the second part of the transitory core, preferably the second part of the transitory core, comprise means for splitting the second split ensemble into:

the second split assembly, and the second part of the transitory core or one or more ensembles comprising the second part of the transitory core, preferably the second part of the transitory core.

Advantageously, in this configuration of the first embodiment in which the transitory core is separated into two parts each with the first and second split assemblies, the means for separating the first split ensemble into the first split assembly and the first part of the transitory core or one or more ensembles comprising the first part of the transitory core, preferably the first part of the transitory core, comprise means for separating the first split ensemble into:

a main ensemble comprising at least one layer made up of M3≥1 helically wound metal filamentary element(s), the M3≥1 metal filamentary element(s) originating from the layer made up of the M6'>1 metal filamentary elements of the first split ensemble, the main ensemble forming the first split assembly, an additional ensemble comprising at least one layer made up of M3≥1 helically wound metal filamentary element(s), the M3≥1 metal filamentary element(s) originating from the layer made up of the M6'>1 metal filamentary elements of the first split ensemble, and the first part of the transitory core or one or more ensembles comprising the first part of the transitory core, preferably the first part of the transitory core.

In a first variant of this configuration of the first embodiment in which the transitory core is separated into two parts each with the first and second split assemblies, the means for separating the first split ensemble into the main ensemble forming the first split assembly, the additional ensemble and the first part of the transitory core or one or more ensembles comprising the first part of the transitory core, preferably the first part of the transitory core, comprise:

means for separating the first split ensemble into:

a precursor ensemble comprising at least one layer made up of M1">1 helically wound metal filamentary elements, the M 1" metal filamentary elements originating from the layer made up of M6'>1 metal filamentary elements of the first split ensemble, the first part of the transitory core or one or more ensembles comprising the first part of the transitory core, preferably the first part of the transitory core, means for separating the precursor ensemble into:

the main ensemble forming the first split assembly and the additional ensemble.

In this first variant of this configuration of the first embodiment, the means for separating the first split ensemble into the precursor ensemble and the first part of the transitory core or one or more ensembles comprising the first part of the transitory core, preferably the first part of the transitory core, are arranged upstream of the means for separating the precursor ensemble into the main ensemble forming the first split assembly and the additional ensemble.

Advantageously, in this first variant of this configuration of the first embodiment, the means for separating the first split ensemble into the precursor ensemble and the first part of the transitory core or one or more ensembles comprising the first part of the transitory core, preferably the first part of the transitory core, comprise means for splitting the first split ensemble into:

the precursor ensemble, and the first part of the transitory core or one or more ensembles comprising the first part of the transitory core, preferably the first part of the transitory core.

Advantageously, in this first variant of this configuration of the first embodiment, the means for separating the precursor ensemble into the main ensemble forming the first split assembly and the additional ensemble comprise means for splitting the precursor ensemble into:

the main ensemble forming the first split assembly, and the additional ensemble.

In a second variant of this configuration of the first embodiment in which the transitory core is separated into two parts each with the first and second split assemblies, the means for separating the first split ensemble into the main ensemble forming the first split assembly, the additional ensemble and the first part of the transitory core or one or more ensembles comprising the first part of the transitory core, preferably the first part of the transitory core, comprise:

means for separating the first split ensemble into:

the main ensemble forming the first split assembly, a derived ensemble comprising at least one layer made up of M5'≥1 metal filamentary element(s) helically wound around the first part of the transitory core, the M5'≥1 metal filamentary element(s) originating from the layer made up of the M6'>1 metal filamentary elements of the first split ensemble, means for separating the derived ensemble into:

the additional ensemble, the first part of the transitory core or one or more ensembles comprising the transitory core, preferably the first part of the transitory core.

In this second variant of this configuration of the first embodiment, the means for separating the first split ensemble into the main ensemble and the derived ensemble are arranged upstream of the means for separating the derived ensemble into the additional ensemble and the first part of the transitory core or one or more ensembles comprising the first part of the transitory core, preferably the first part of the transitory core.

Advantageously, in this second variant of this configuration of the first embodiment, the means for separating the first split ensemble into the main ensemble forming the first split assembly and the derived ensemble comprise means for splitting the first split ensemble into:

the main ensemble forming the first split assembly, and the derived ensemble.

Advantageously, in this second variant of this configuration of the first embodiment, the means for separating the derived ensemble into the additional ensemble and the first part of the transitory core or one or more ensembles comprising the transitory core, preferably the first part of the transitory core, comprise means for splitting the derived ensemble into:

the additional ensemble, and the first part of the transitory core or one or more ensembles comprising the transitory core, preferably the first part of the transitory core.

In another configuration of the first embodiment in which the transitory core is separated into two parts, the means for separating the transitory assembly into at least the first split assembly, the second split assembly and the transitory core or one or more ensembles comprising the transitory core comprise, upstream of the reassembly means, means for splitting the transitory assembly into:

the first split assembly, the second split assembly, a first part of the transitory core, a second part of the transitory core, the first part of the transitory core and the second part of the transitory core constituting, prior to the step of separating the transitory assembly, the transitory core, a split ensemble comprising at least one layer made up of M4'≥1 helically wound metal filamentary element(s), the M4' metal filamentary element(s) originating from the layer made up of M' metal filamentary elements of the transitory assembly.

In a second embodiment for total reassembly of the M' metal filamentary elements, the separation means and the reassembly means are arranged such that M1'+M2'=M'.

In a first variant of the second embodiment in which the transitory core is separated from the first split assembly, the means for separating the transitory assembly into at least the first split assembly, the second split assembly and the transitory core or one or more ensembles comprising the transitory core comprise, upstream of the reassembly means:

means for separating the transitory assembly into:

a split ensemble comprising at least one layer made up of M4'≥1 metal filamentary element(s) helically wound around the transitory core, the M4'≥1 metal filamentary element(s) originating from the layer made up of the M'>1 metal filamentary elements of the transitory assembly and the second split assembly, means for separating the split ensemble into:

the first split assembly, and the transitory core.

In this first variant of the second embodiment, the means for separating the transitory assembly into the split ensemble and the second split assembly are arranged upstream of the means for separating the split ensemble into the first split assembly and the transitory core.

Advantageously, in this first variant of the second embodiment, the means for separating the transitory assembly into the split ensemble and the second split assembly comprise means for splitting the transitory assembly into the split ensemble and the second split assembly.

Advantageously, in this first variant of the second embodiment, the means for separating the split ensemble into the first split assembly and the transitory core comprise means for splitting the split ensemble into:

the first split assembly, and the transitory core.

In a second variant of the second embodiment in which the transitory core is separated from the second split assembly, the means for separating the transitory assembly into at least the first split assembly, the second split assembly and the transitory core or one or more ensembles comprising the transitory core comprise, upstream of the reassembly means:

means for separating the transitory assembly into:

a split ensemble comprising at least one layer made up of M4'>1 metal filamentary elements helically wound around the transitory core, the M4'>1 metal filamentary elements originating from the layer made up of the M'>1 metal filamentary elements of the transitory assembly, and the first split assembly, means for separating the split ensemble into:

the second split assembly, and the transitory core.

In this second variant of the second embodiment, the means for separating the transitory assembly into the split ensemble and the first split assembly are arranged upstream of the means for separating the split ensemble into the second split assembly and the transitory core.

Advantageously, in this second variant of the second embodiment, the means for separating the transitory assembly into the split ensemble and the first split assembly comprise means for splitting the transitory assembly into:

the split ensemble, and the first split assembly.

Advantageously, in this second variant of the second embodiment, the means for separating the split ensemble into the second split assembly and the transitory core comprise means for splitting the split ensemble into:

the second split assembly, and the transitory core.

In a third variant of the second embodiment in which the transitory core is separated into two parts each with the first and second split assemblies, the means for separating the transitory assembly into at least the first split assembly, the second split assembly and the transitory core or one or more ensembles comprising the transitory core comprise, upstream of the reassembly means:

means for separating the transitory assembly into:

a first split ensemble comprising at least one layer made up of M6'≥1 metal filamentary element(s) helically wound around a first part of the transitory core, the M6'≥1 metal filamentary element(s) originating from the layer made up of the M' metal filamentary elements of the transitory assembly, and a second split ensemble comprising at least one layer made up of M7'>1 metal filamentary elements helically wound around a second part of the transitory core, the M7'>1 metal filamentary elements originating from the layer made up of the M' metal filamentary elements of the transitory assembly, the first part of the transitory core and the second part of the transitory core constituting, upstream of the means for separating the transitory assembly, the transitory core, means for separating the first split ensemble into:

the first split assembly, and the first part of the transitory core, means for separating the second split ensemble into:

the second split assembly, and the second part of the transitory core.

In this third variant of the second embodiment, the means for separating the transitory assembly into the first split ensemble and the second split ensemble are arranged upstream of the means for separating the first split ensemble into the first split assembly and the first part of the transitory core.

In this configuration of the second embodiment, the means for separating the transitory assembly into the first split ensemble and the second split ensemble are arranged upstream of the means for separating the second split ensemble into the second split assembly and the second part of the transitory core.

Advantageously, in this third variant of the second embodiment, the means for separating the transitory assembly into the first split ensemble and the second split ensemble comprise means for splitting the transitory assembly into the first split ensemble and the second split ensemble.

Advantageously, in this third variant of the second embodiment, the means for separating the first split ensemble into the first split assembly and the first part of the transitory core comprise means for splitting the first split ensemble into:

the first split assembly, and the first part of the transitory core.

Advantageously, in this third variant of the second embodiment, the means for separating the second split ensemble into the second split assembly and the second part of the transitory core comprise means for splitting the second split ensemble into:

the second split assembly, and the second part of the transitory core.

In a fourth variant of the second embodiment in which the first split assembly, the second split assembly and the transitory core are separated simultaneously, the means for separating the transitory assembly into at least the first split assembly, the second split assembly and the transitory core comprise, upstream of the reassembly means, means for splitting the transitory assembly into:

the first split assembly, the second split assembly, and the transitory core.

In a fifth variant of the second embodiment in which the transitory core is separated into two parts, the means for separating the transitory assembly into at least the first split assembly, the second split assembly and the transitory core comprise, upstream of the reassembly means, means of splitting the transitory assembly into:

the first split assembly, the second split assembly, a first part of the transitory core, a second part of the transitory core, the first part of the transitory core and the second part of the transitory core constituting, prior to the step of separating the transitory assembly, the transitory core.

Highly preferably, the means for supplying the transitory assembly comprise means for assembling, by twisting, the M'>1 metal filamentary elements helically wound around the transitory core.

Advantageously, the means for supplying the transitory assembly comprise means for balancing the transitory assembly.

BRIEF DESCRIPTION OF THE FIGURES

The invention will be understood better on reading the following description, which is given purely by way of non-limiting example and with reference to the drawings, in which.

INSTALLATION AND METHOD ACCORDING TO A FIRST EMBODIMENT OF THE INVENTION

Figure 1:
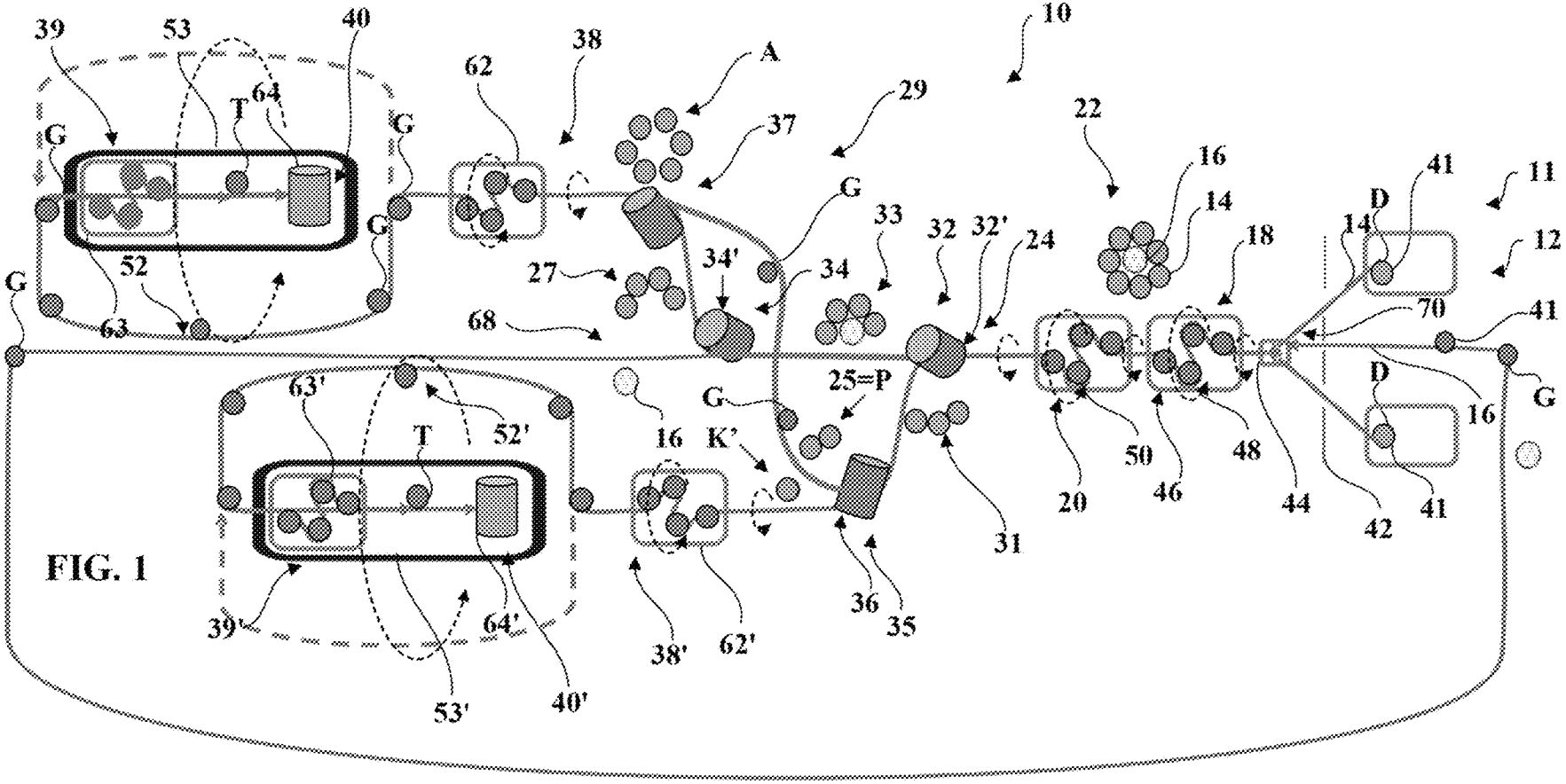
FIG. 1 is a diagram of an installation according to a first embodiment of the invention and making it possible to implement a method according to a first embodiment of the invention and to manufacture the cord of FIG. 11.
Figure 11:
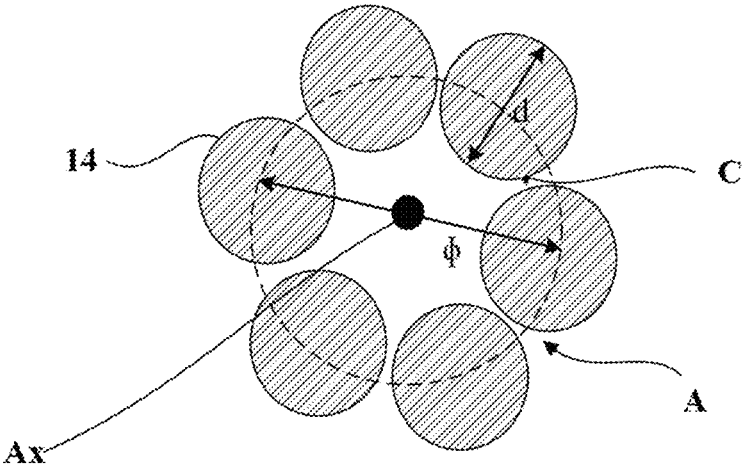
FIG. 11 is a view in section perpendicular to the axis of the assembly (assumed to be rectilinear and at rest) of a final assembly originating from the reassembly of the first and second split assemblies of FIGS. 8 and 9.
Figure 12:
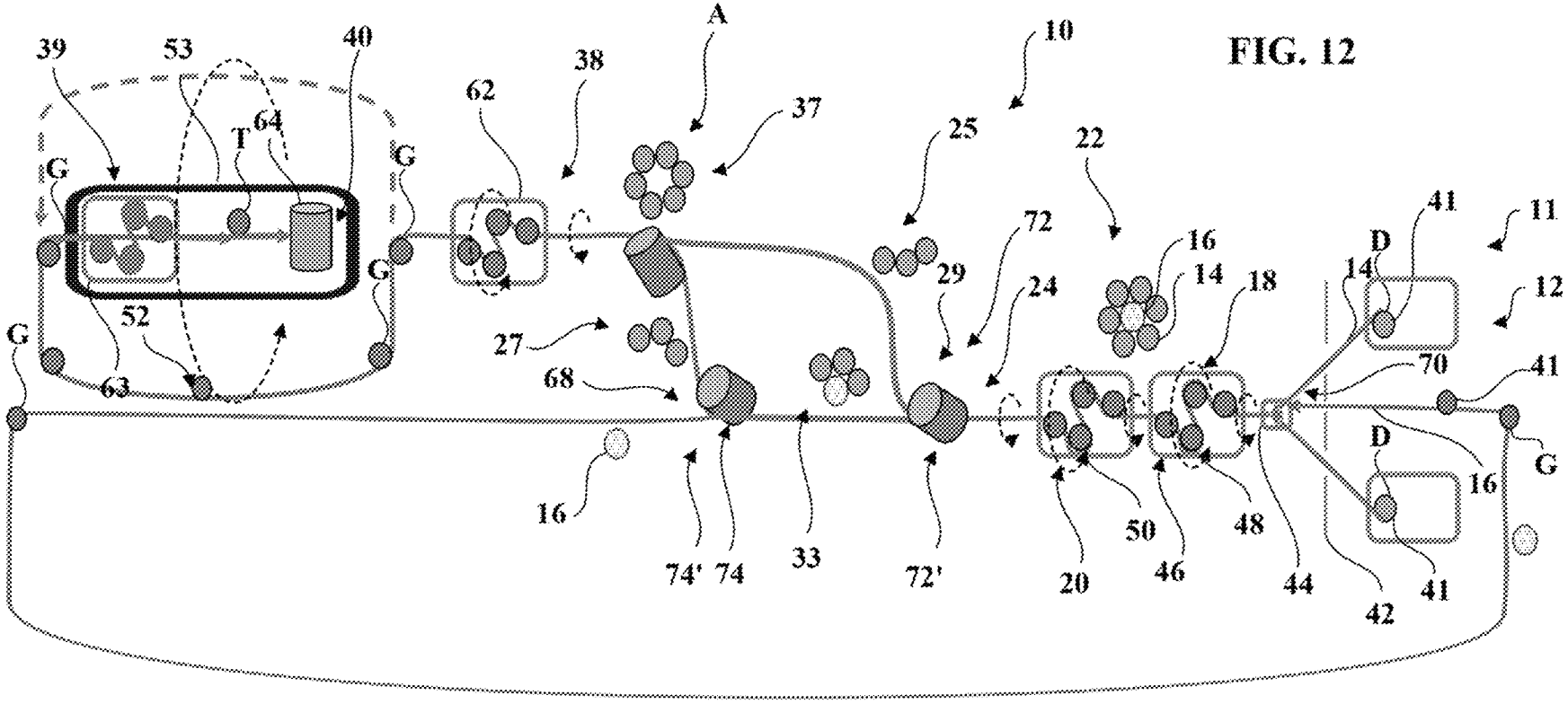
FIGS. 12 and 13 are representations similar to those of FIGS. 1 and 2 of an installation and of a method according to a second embodiment making it possible to manufacture the cord of FIG. 18.
Figure 13:
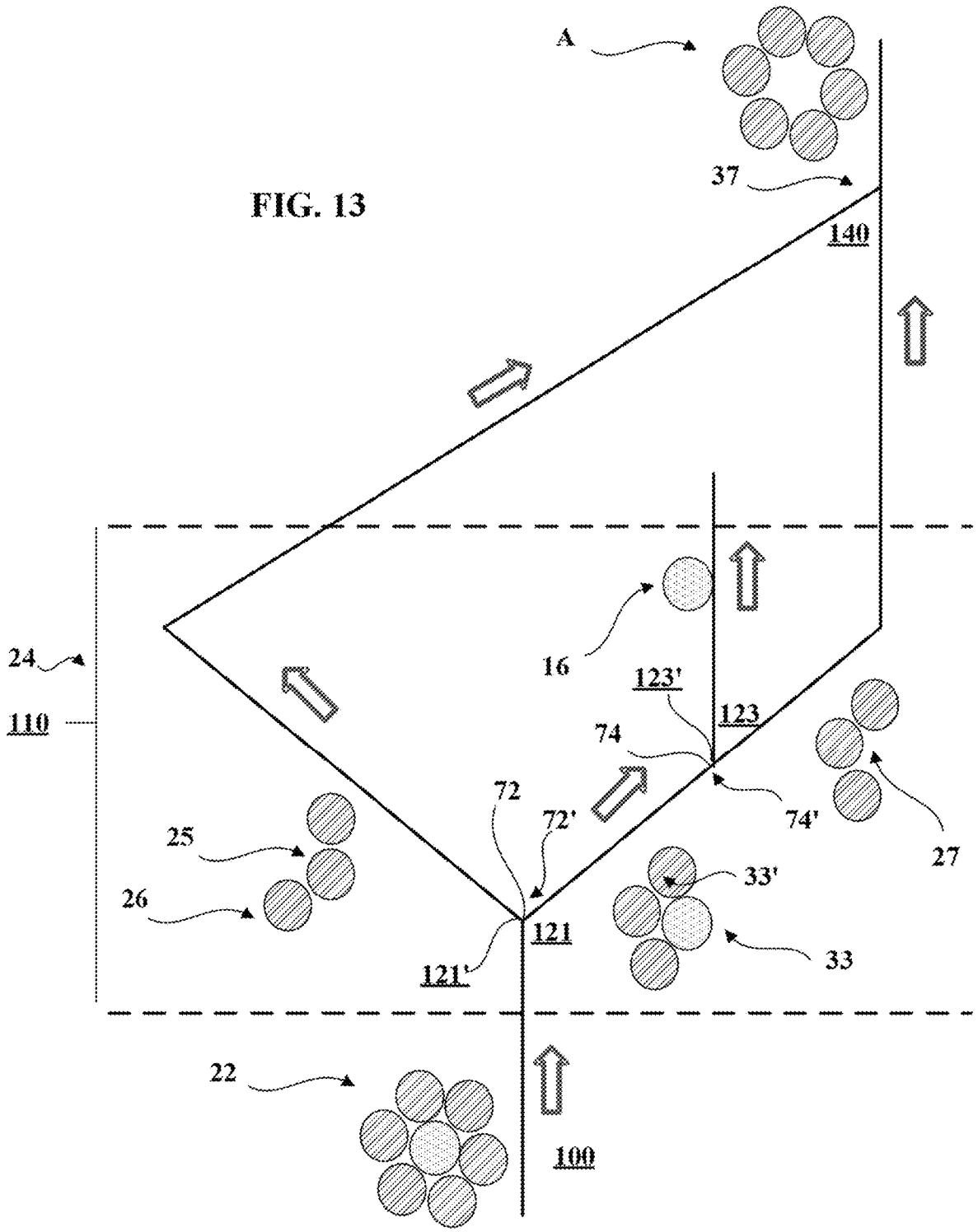
Figure 14:
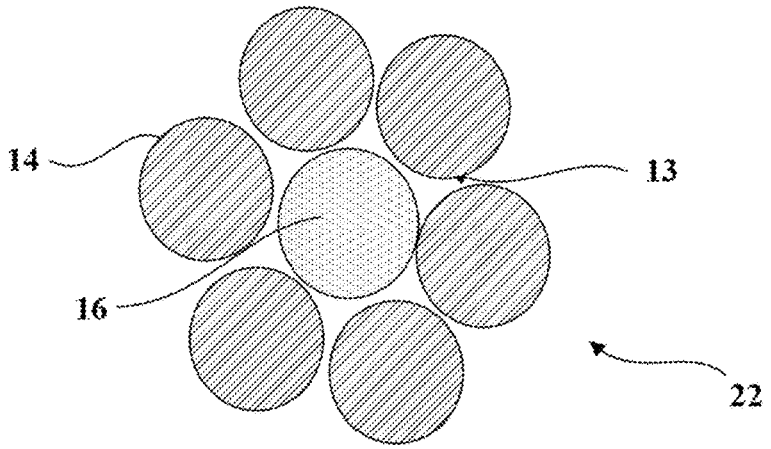
FIG. 14 is a view in section perpendicular to the axis of the assembly (assumed to be rectilinear and at rest) of a transitory assembly of the method illustrated in FIGS. 12 and 13.
Figure 15:
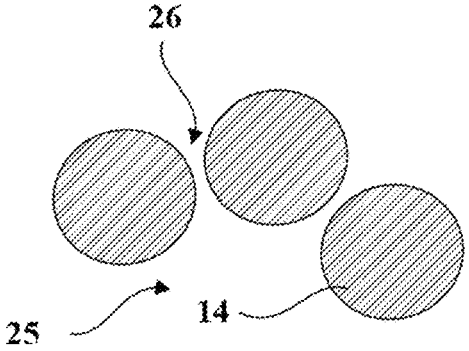
FIG. 15 is a view in section perpendicular to the axis of the assembly (assumed to be rectilinear and at rest) of a first split assembly originating from the transitory assembly of FIG. 14.
Figure 16:
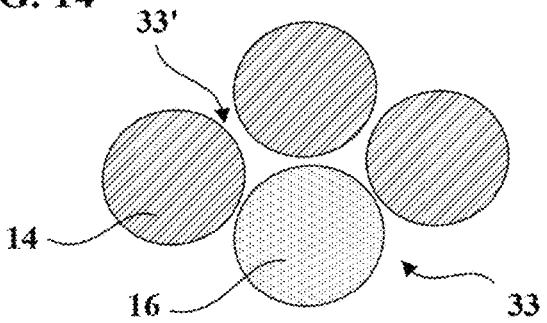
FIG. 16 is a view in section perpendicular to the axis of the assembly (assumed to be rectilinear and at rest) of a split assembly originating from the transitory assembly of FIG. 14.
Figure 17:
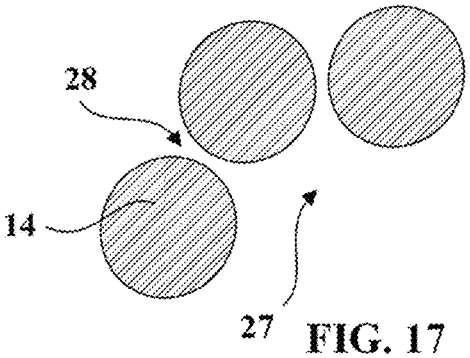
FIG. 17 is a view in section perpendicular to the axis of the assembly (assumed to be rectilinear and at rest) of a second split assembly originating from the split assembly of FIG. 16.
Figure 18:
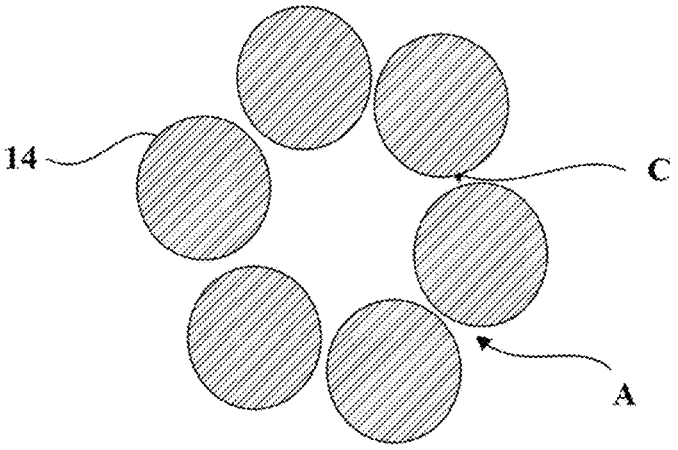
FIG. 18 is a view in section perpendicular to the axis of the assembly (assumed to be rectilinear and at rest) of a final assembly originating from the reassembly of the first and second split assemblies of FIGS. 15 and 17.

FIG. 1 shows an installation for manufacturing a final assembly A comprising at least one layer C of N'>1 metal filamentary elements 14 wound in a helix. In this case, the final assembly A consists of the layer C of N'=6 metal filamentary elements 14 wound in a helix and is represented in FIG. 11. Thus, the final assembly A consists of the single layer C, in other words the final assembly A does not include any other metal filamentary element than those of the layer C. The final assembly A has a main axis Ax extending substantially parallel to the direction in which the final assembly A extends along its greatest length. Each metal filamentary element 14 of the layer C describes, when the final assembly A extends in a substantially rectilinear direction, a helix-shaped path around the main axis Ax substantially parallel to the substantially rectilinear direction, so that, in a section plane substantially perpendicular to the main axis Ax, the distance between the centre of each metal filamentary element 14 of the layer C and the main axis Ax is substantially constant and equal for all the metal filamentary elements 14 of the layer C. This constant distance between the centre of each metal filamentary element 14 of the layer C and the main axis Ax is equal to half the diameter of the helix.

Figure 5:
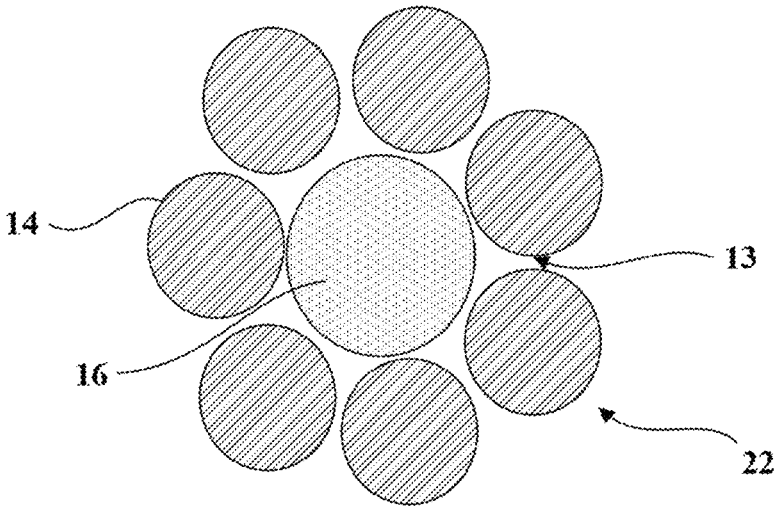
FIG. 5 is a view in section perpendicular to the axis of the assembly (assumed to be rectilinear and at rest) of a transitory assembly of the method illustrated in FIGS. 1 and 2.

The installation is denoted by the overall reference 10. The installation 10 comprises first of all means 11 for supplying a transitory assembly 22 comprising at least one, and in this case consisting of one, layer 13 made up of M'>1 metal filamentary elements 14 helically wound around a transitory core 16. The transitory assembly 22 shown in FIG. 5 comprises the layer 13 made up of the M' metal filamentary elements 14 and the transitory core 16, the M' metal filamentary elements 14 being helically wound around the transitory core 16. In this case, the transitory assembly 22 consists of the layer 13 made up of the M'=7 metal filamentary elements 14 and of the transitory core 16, the M' metal filamentary elements 14 being helically wound around the transitory core 16. Each metal filamentary element 14 comprises, here consists of, a single metallic elementary monofilament of circular cross section, in this instance made of carbon steel, having a diameter d ranging from 0.05 mm to 0.50 mm, preferably from 0.10 mm to 0.48 mm, and more preferably from 0.15 mm to 0.45 mm, and, in this instance, with d=0.32 mm. The transitory core here is a textile filamentary element, and more particularly here is a multifilament textile strand made of polyester with a count of 334 tex and a diameter equal to 0.60 mm.

The supply means 11 comprise means 12 for feeding in the M' metal filamentary elements 14 and the transitory core 16. The supply means 11 also comprise means 18 for assembling, by twisting, the M' metal filamentary elements 14 together in the layer 13 of M' metal filamentary elements 14 around the transitory core 16 so as to form the transitory assembly 22. Furthermore, the supply means 11 comprise means 20 for balancing the transitory assembly 22. On exiting the means 20, each metal filamentary element 14 of the transitory assembly 22 is, in this case, assembled at a transitory pitch equal to 5 mm. The transitory helix diameter of each metal filamentary element 14 of the transitory assembly 22 is, in this case, substantially equal to 0.92 mm.

Downstream of the supply means 11, considering the direction of travel of the metal filamentary elements, the installation 10 comprises means 24 for separating the transitory assembly 22 into a first split assembly 25, a second split assembly 27 and the transitory core 16 or one or more ensembles comprising the transitory core 16, in this case the transitory core 16.

Figure 9:
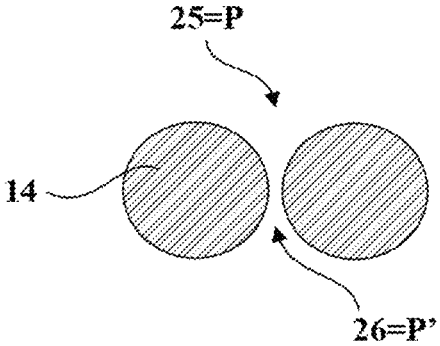
FIG. 9 is a view in section perpendicular to the axis of the assembly (assumed to be rectilinear and at rest) of a main ensemble originating from the precursor ensemble of FIG. 6 and forming a first split assembly.

The first split assembly 25 shown in FIG. 9 comprises at least one layer 26, here consists of the layer 26, consisting of M1'≥1 metal filamentary element(s) 14 wound in a helix. In this case, M1'=2. The M1' metal filamentary elements originate from the layer 13 of the transitory assembly 22.

Figure 8:
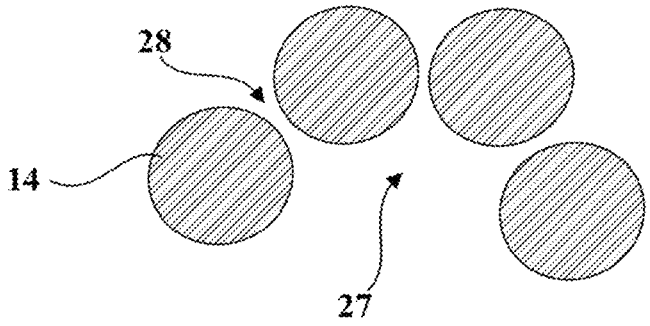
FIG. 8 is a view in section perpendicular to the axis of the assembly (assumed to be rectilinear and at rest) of a second split assembly originating from the split assembly of FIG. 7.

The second split assembly 27 shown in FIG. 8 comprises at least one layer 28, here consists of the layer 28, consisting of M2'>1 metal filamentary elements 14 wound in a helix. In this case, M2'=4. The M2' metal filamentary elements originate from the layer 13 of the transitory assembly 22.

Figure 6:
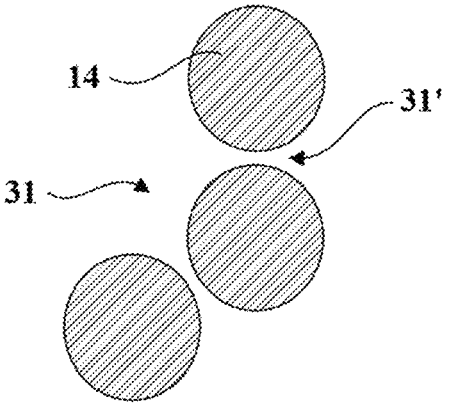
FIG. 6 is a view in section perpendicular to the axis of the assembly (assumed to be rectilinear and at rest) of a precursor assembly originating from the transitory assembly of FIG. 5.

Downstream of the supply means 11, the means 24 for separating the transitory assembly 22 into the first split assembly 25, the second split assembly 27 and the transitory core 16 comprise means 29 for separating the transitory assembly 22 into a precursor ensemble 31, the second split assembly 27 and finally the transitory core 16. The precursor ensemble 31 is illustrated in FIG. 6 and comprises at least one, here consists of one, layer 31' made up of M1">1 metal filamentary elements wound in a helix, the M 1" metal filamentary elements 14 originating from the layer 13 of the transitory assembly 22. In this case, M1"=3.

The means 29 for separating the transitory assembly 22 into the precursor ensemble 31, the second split assembly 27 and the transitory core 22 comprise means 32 for separating the transitory assembly 22 into the precursor ensemble 31 and a split ensemble 33 comprising at least one layer 33' constituted by M4'>1 metal filamentary elements 14 helically wound around the transitory core 16. The M4' metal filamentary elements 14 originate from the layer 13 of the transitory assembly 22. Here, the separation means 32 comprise means 32' for splitting the transitory assembly 22 into the precursor ensemble 31 and the split ensemble 33. In this case, M4'=4.

Figure 7:
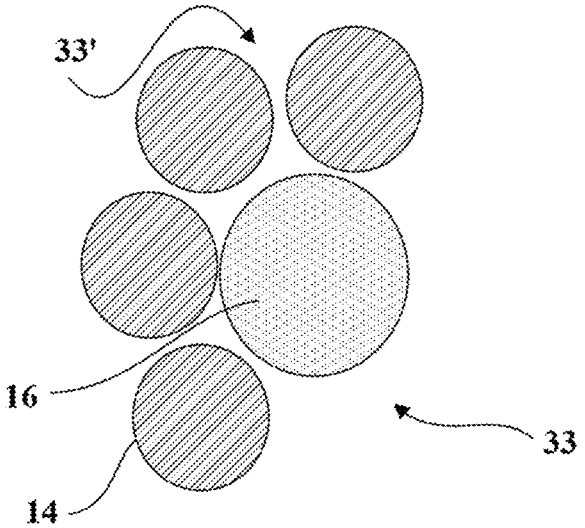
FIG. 7 is a view in section perpendicular to the axis of the assembly (assumed to be rectilinear and at rest) of a split assembly originating from the transitory assembly of FIG. 5.

Thus, the split ensemble 33 comprises the layer 33' and the transitory core 16, the M4' metal elements being helically wound around the transitory core 16. The split ensemble 33 is illustrated in FIG. 7 and consists of the layer 33' made up of the M4' metal filamentary elements wound in a helix and of the transitory core 16, the M4' metal elements being helically wound around the transitory core 16.

Downstream of the separation means 29, the means 24 for separating the transitory assembly 22 into the first split assembly 25, the second split assembly 27 and the transitory core 16 comprise means 34 for separating the split ensemble 33 into the second split assembly 27 and the transitory core 16. Here, the separation means 34 comprise means 34' for splitting the split ensemble 33 into the second split assembly 27 and the transitory core 16.

Downstream of the supply means 11, the means 24 for separating the transitory assembly 22 into the first split assembly 25, the second split assembly 27 and the transitory core 16 also comprise means 35 for separating the precursor ensemble 31 into a main ensemble P forming the first split assembly 25 and an additional ensemble K. The means 35 for separating the precursor ensemble 31 into the main P and additional K ensembles comprise means 36 for splitting the precursor ensemble 31 into the main ensemble P and the additional ensemble K.

The main ensemble P comprises a layer P' made up of M3≥1 metal filamentary element(s) wound in a helix, the M3≥1 metal filamentary element(s) originating from the layer 31' made up of the M1" metal filamentary elements of the precursor ensemble 31. Here, the main ensemble P, illustrated in FIG. 9, consists of the layer P' made up of M3=2 metal filamentary elements 14 wound in a helix.

Figure 10:
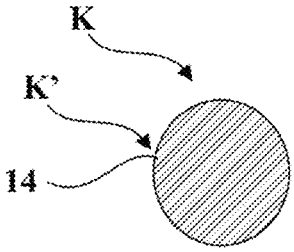
FIG. 10 is a view in section perpendicular to the axis of the assembly (assumed to be rectilinear and at rest) of an additional ensemble originating from the precursor ensemble of FIG. 6.

The additional ensemble K comprises a layer K' made up of M3'≥1 metal filamentary element(s) wound in a helix, the M3'≥1 metal filamentary element(s) originating from the layer 31' made up of the M1" metal filamentary elements of the precursor ensemble 31. Here, the additional ensemble K, illustrated in FIG. 10, consists of the layer K' made up of M3=1 metal filamentary element 14 wound in a helix and forms the first split assembly 25.

In this case, M3=M1' et M3+M3'=M1".

Downstream of the separation means 24, 29, 34 and 35, the installation 10 comprises means 37 for reassembling the first split assembly 25 with the second split assembly 27 to form the layer C consisting of N' metal filamentary elements 14 wound in a helix. In this first embodiment, the reassembly means 37 are means for reassembling the main ensemble P forming the first split assembly 25 with the second split assembly 27 to form the layer C. In this case, owing to the elastic return of each metal filamentary element 14 in response to the twisting step, the pitch of each metal filamentary element 14 of the transitory assembly 22 changes from the transitory pitch equal to 5 mm to the pitch p here equal to 7.8 mm. A person skilled in the art will know how to determine which transitory pitch to apply in order to obtain the desired pitch p.

The helix diameter ϕ of each metal filamentary element 14 in the final assembly is here substantially greater than the transitory helix diameter of each filamentary element 14 in the transitory assembly 22, because of the elastic return. The helix diameter ϕ of each metal filamentary element 14 in the final assembly is all the more greater than the transitory helix diameter of each filamentary element 14 in the transitory assembly 22 as the twist rate increases. A person skilled in the art will know how to determine the transitory helix diameter to apply in order to obtain the desired helix diameter ϕ, depending on the degree of twist and on the nature of the transitory core.

The supply means 11, the separation means 24 and the reassembly means 37 are arranged so that all the N' metal filamentary elements 14 have the same diameter d=0.32 mm, are helically wound at the same pitch p=7.8 mm and have the same helix diameter ϕ=0.95 mm.

In FIG. 1, downstream of the reassembly means 37 considering the direction of travel of the metal filamentary elements, the installation 10 comprises means 38, 38' for maintaining the rotation respectively of the final assembly A and of the additional ensemble K around their direction of travel.

Downstream of the rotation maintenance means 38, 38' considering the direction of travel of the metal filamentary elements 14, the installation 10 comprises means 39, 39' for respectively balancing the final assembly A and the additional ensemble K.

Downstream of the balancing means 39, 39' considering the direction of travel of the metal filamentary elements 14, the installation 10 comprises means 40, 40' for respectively storing the final assembly A and the additional ensemble K.

The installation 10 also comprises means G of guiding, D of paying out, and T of applying tension to the filamentary elements, ensembles and assemblies, as are conventionally used by those skilled in the art, for example pulleys and capstans.

The supply means 12 here comprise seven spools 41 for storing each filamentary element 14 as well as a spool 41 for storing the transitory core 16. In FIG. 1, only two of the seven spools 41 are shown for reasons of clarity of the figure.

The assembly means 18 comprise a distributor 42 and an assembly guide 44. The assembly means 18 comprise means 46 for twisting the M' filamentary elements 14 and the transitory core 16. The twisting means 46 comprise a twisting device 48, also more commonly known to those skilled in the art as a "twister", for example a four-pulley twister. Downstream of these twisting means 46, the twist-balancing means 20 comprise a twister 50, for example a four-pulley twister. Finally, downstream of the twister 48, the assembly means 18 comprise a bow 52 and a pod 53 bearing the final balancing means 39 and the storage means 40. The bow 52 and the pod 53 are mounted to be able to rotate so as to maintain the assembly pitch of the final assembly A. The installation 10 also comprises a bow 52' and a pod 53' for the additional ensemble K.

Figure 3:
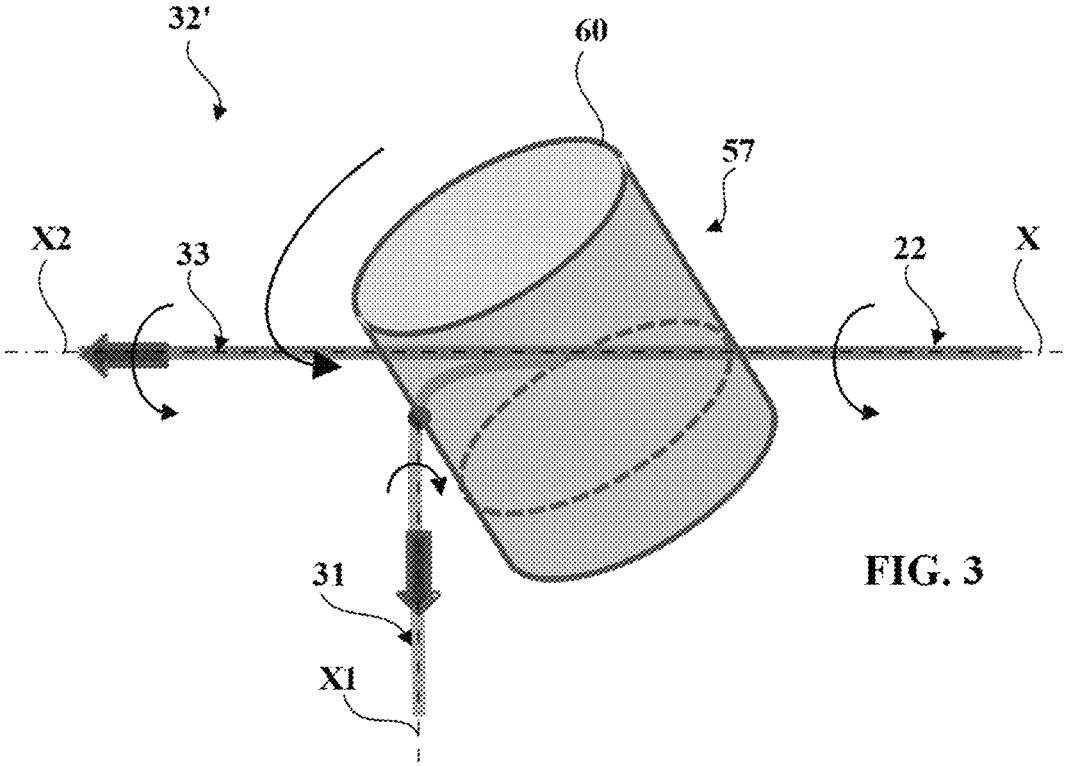
FIGS. 3 and 4 are diagrams of splitting and reassembling means of the installation of FIG. 1.

FIG. 3 depicts the splitting means 32'. The transitory assembly 22 progresses in an upstream direction of travel X. After passing through the splitting means 32', the split ensemble 33 progresses in a downstream direction of travel X2 and the precursor ensemble 31 progresses in a downstream direction X1. The splitting means 32' comprise guide means 57 allowing, on the one hand, the translation of the split 33 and precursor 31 ensemble respectively in the downstream directions X2, X1, and, on the other hand, the rotation of the split 33 and precursor 31 ensemble respectively around the downstream directions X2, X1. In this particular instance, the means 57 comprise an inclined rotary roller 60. The splitting means 34' and 36 are similar to the splitting means 32' described above. During the method, the precursor ensemble 31 comes into contact with the roller 60 downstream of the point of splitting into the split 33 and precursor 31 ensembles.

Figure 4:
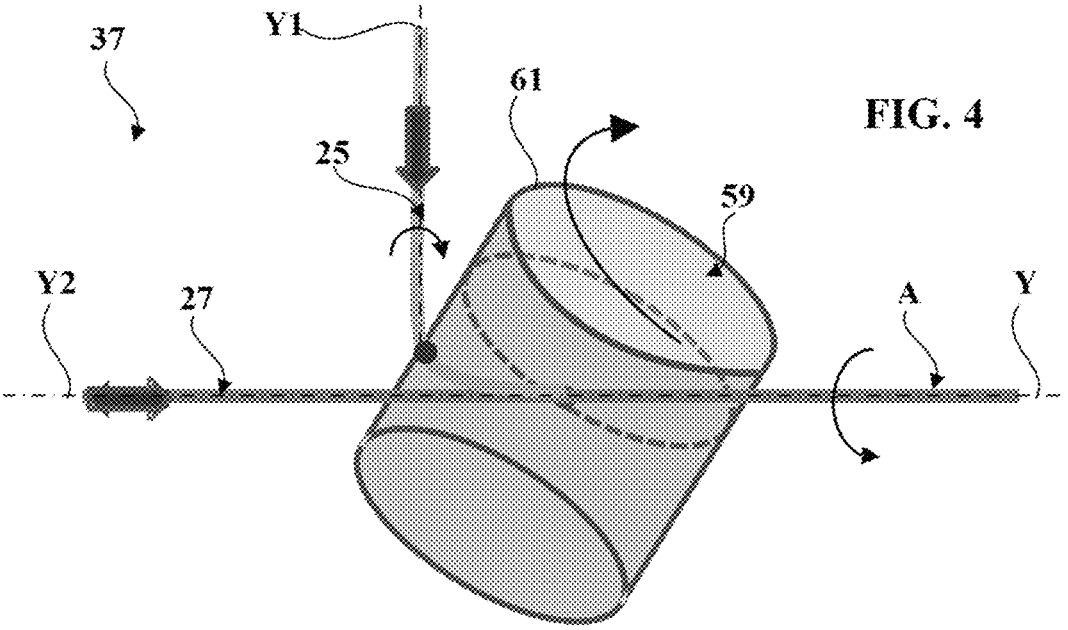

FIG. 4 depicts the reassembly means 37. The first split assembly 25 progresses in an upstream direction of travel Y1. The second split assembly 27 progresses in an upstream direction of travel Y2. The final assembly A progresses in a downstream direction of travel Y. The reassembly means 37 comprise guide means 59 allowing, on the one hand, the translation of the first and second split assemblies 25, 27 respectively in the downstream directions Y1, Y2, and, on the other hand, the rotation of the first and second split assemblies 25, 27 respectively around the downstream directions Y1, Y2. In this particular instance, the means 59 comprise an inclined rotary roller 61. During the method, the first split assembly 25 comes into contact with the roller 61 upstream of the point of reassembly of the first and second split assemblies 25, 27.

The means 38, 38' for maintaining the rotation comprise twisters 62, 62', for example twisters with four pulleys making it possible to maintain the rotation of the final assembly A respectively around the downstream direction. The final balancing means 39, 39' also comprise twisters 63, 63', for example four-pulley twisters. The storage means 40, 40' here comprise spools 64, 64' respectively for storing the final assembly A and the additional ensemble K.

In order to recycle the transitory core 16, the installation 10 comprises guide means G for guiding the transitory core 16 between, on the one hand, an exit 68 from the separation means 24, in this instance downstream of the splitting means 34 and, on the other hand, an entry 70 into the assembly means 18.

It will be noted that the installation 10 has no preforming means, particularly means for individually preforming the filamentary elements 14, arranged upstream of the assembly means 18.

Figure 2:
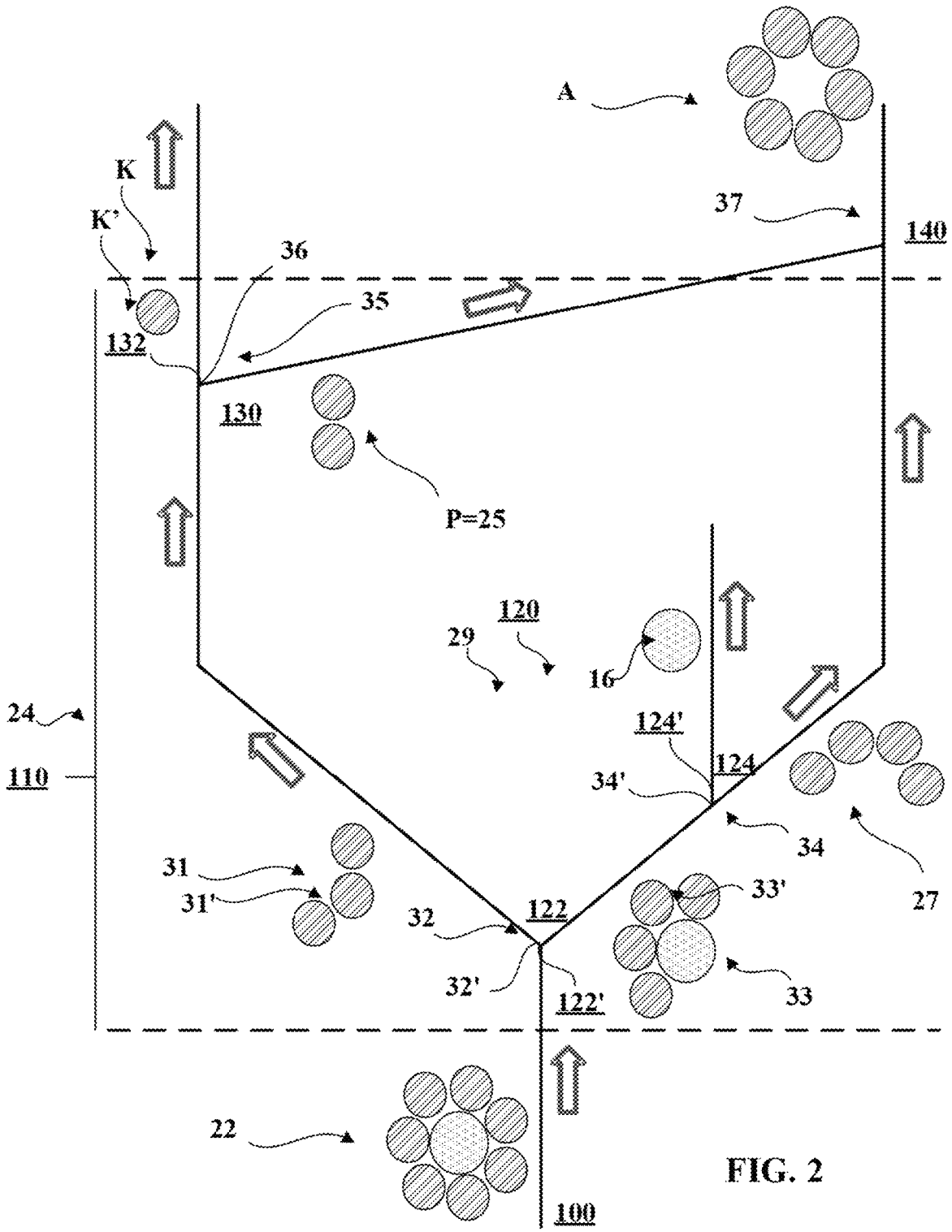
FIG. 2 is a schematic depiction of the installation and of the method which are illustrated in FIG. 1.

The various means 24, 29, 32, 32', 34, 34', 35, 36, 37 as well as the various assemblies and ensembles 22, 25, 27, 31, 33, P, K are shown schematically in the FIG. 2 in which the arrows indicate the direction of travel of these assemblies and ensembles from downstream to upstream.

The method according to the first embodiment allowing implementation of the installation 10 described hereinabove will now be described. The method makes it possible to manufacture the final assembly A described above.

First of all, the filamentary elements 14 and the transitory core 16 are paid out from the feed means 12, in this instance the spools 41.

Next, the method comprises a step 100 of supplying the transitory assembly 22 comprising, on the one hand, a step of assembly by twisting the M' metal filamentary elements 14 in a single layer of M' metal filamentary elements 14 around the transitory core 16 and, on the other hand, a step of balancing the transitory assembly 22 carried out by means of the twister 50.

The method comprises a step 110 of separating the transitory assembly 22 into the first split assembly 25, the second split assembly 27 and the transitory core 16 or one or more ensembles comprising the transitory core 16, in this case the transitory core 16.

Downstream of the supply means 11, the step 110 of separating the transitory assembly 22 into the first split assembly 25, the second split assembly 27 and the transitory core 16 comprises a step 120 of separating the transitory assembly 22 into the precursor ensemble 31, the second split assembly 27 and finally the transitory core 16.

The step 120 of separating the transitory assembly 22 into the precursor ensemble 31, the second split assembly 27 and the transitory core comprises a step 122 of separating the transitory assembly 22 into the precursor ensemble 31 and the split ensemble 33. Here, the separation step 122 comprises a step 122' of splitting of the transitory assembly 22 into the precursor ensemble 31 and the split ensemble 33.

Downstream of the separation step 122, the step 120 of separating the transitory assembly into the precursor ensemble 31 and the split ensemble 33 comprises a step 124 of separating the split ensemble 33 into the second split assembly 27 and the transitory core 16. In this case, the separation step 124 comprises a step 124' of splitting the split ensemble 33 into the second split assembly 27 and the transitory core 16.

Downstream of the supply step 100, the step 110 of separating the transitory assembly into the first split assembly 25, the second split assembly 27 and the transitory core 16 comprises a step 130 of separating the precursor ensemble 31 into the main ensemble P forming the first split assembly 25 and the additional ensemble K. The step 130 of separating the precursor ensemble 31 into the main P and additional K ensemble comprises a step 132 of splitting of the precursor ensemble 31 into the main ensemble P and the additional ensemble K.

The step 120 of separating the transitory assembly 22 into the precursor ensemble 31, the second split assembly 27 and the transitory core 16 takes place upstream of the step 130 of separating the precursor ensemble 31 into the main P and additional K ensembles. Similarly, the separation means 29 are arranged upstream of the separation means 35.

The step 122 of separating 122 the transitory assembly into the split ensemble 33 and the precursor ensemble 31 takes place upstream of the step 124 of separating the split ensemble 33 into the second split assembly 27 and the transitory core 16. Similarly, the separation means 32 are arranged upstream of the separation means 34.

Downstream of the separation steps 110, 120, 124 and 130, the method comprises a step 140 of reassembling the first split assembly 25 with the second split assembly 27 to form the layer C. In this first embodiment, the reassembly step 140 is a step of reassembling the main ensemble P forming the first split assembly 25 with the second split assembly 27 to form the layer C.

In this embodiment, the supply step 100, the separation step 110 and the reassembly step 140 are carried out so that all the N' metal filamentary elements 14 have the same diameter d, are helically wound at the same pitch p and have the same helix diameter $\phi$ that are described above.

In the first embodiment allowing a partial reassembly of the M' metal filamentary elements, the separation step 110 and the reassembly step 140 are carried out so that $M1'+M2'<M'$. Similarly, the separation means 24 and the reassembly means 37 are arranged so that $M1+M2'<M'$. In addition, $M'>M1''+M2'$, $M1''=M3+M3'$, $M1'=M3$, $M'=M4'+M1''$ and $M4'=M2'$.

Finally, it will be noted that $M2'=4\leq 0.75\times M'=5.25$, and here $M2'=4\leq 0.70\times M'=4.9$ with here $M'=7$, which allows easy separation of the transitory core.

In addition, the method comprises steps of maintaining the rotation of the final assembly A and of the assembly formed by the additional ensemble K around their respective directions of travel. These maintenance steps are carried out downstream of the step of separating the transitory assembly 22 by virtue of the means 38 and 38'.

A final balancing step is carried out by virtue of the means 39 and 39'.

Finally, the final assembly A and the additional ensemble K are stored in the storage spools 64, 64'.

As regards the transitory core 16, the method comprises a step of recycling the transitory core 16. During this recycling step, the transitory core 16 is recovered downstream of the separation step 110, in this case downstream of the separation step 124, and the transitory core 16 previously recovered is introduced upstream of the assembly step. This recycling step is continuous.

It will be noted that the method thus described does not have steps of individually preforming each of the metal filamentary elements 14.

INSTALLATION AND METHOD ACCORDING TO A SECOND EMBODIMENT OF THE INVENTION

An installation and a method according to the second embodiment of the invention will now be described with reference to FIGS. 12 to 18. Elements similar to those of the first embodiment are denoted by identical references.

Unlike the first embodiment, the separation step 110 and the reassembly step 140 are carried out so that $M1'+M2'=M'$. Similarly, the separation means 24 and the reassembly means 37 are arranged so that $M1'+M2'=M'$.

Unlike the first embodiment, the means 24 for separating the transitory assembly 22 into the first split assembly 25, the second split assembly 27 and the transitory core 16 comprise means 72 for separating the transitory assembly 22 into the first split assembly 25 and a split ensemble 33 comprising at least one layer 33' consisting of $M4'=3$ metal filamentary elements 14 helically wound around the transitory core 16, the M4' metal filamentary elements 14 originating from the layer 13 formed of the $M'>1$ metal filamentary elements 14 of the transitory assembly 22. The split ensemble 33 thus comprises the layer 33' and the transitory core 16, the M4' metal filamentary elements 14 being helically wound around the transitory core 16. In this case, the split ensemble 33 is made up of the layer 33' and of the transitory core 16, the M4' metal filamentary elements 14 being helically wound around the transitory core 16. In this case, the separation means 72 comprise means 72' for splitting the transitory assembly 22 into the first split assembly 25 and the split ensemble 33.

Thus, the step 110 of separating the transitory assembly 22 into the first split assembly 25, the second split assembly 27 and the transitory core 16 comprises a step 121 of separating the transitory assembly 22 into the first split assembly 25 and the split ensemble 33. In this case, the separation step 121 comprises a step 121' of splitting the transitory assembly 22 into the first split assembly 25 and the split ensemble 33.

Unlike the first embodiment, the means 24 for separating the transitory assembly 22 into the first split assembly 25, the second split assembly 27 and the transitory core 16 comprise means 74 for separating the split ensemble 33 into the second split assembly 27 and the transitory core 16. In this case, the separation means 74 comprise means 74' for splitting the split ensemble 33 into the second split assembly 27 and the transitory core 16.

Thus, the step 110 of separating the transitory assembly 22 into the first split assembly 25, the second split assembly 27 and the transitory core 16 comprises a step 123 of separating the split ensemble 33 into the second split assembly 27 and the transitory core 16. In this case, the separation step 123 comprises a step 123' of splitting the split ensemble 33 into the second split assembly 27 and the transitory core 16.

In this second embodiment, the separation means 72 are arranged upstream of the separation means 74. Similarly, the separation step 121 takes place upstream of the separation step 123.

It will also be noted that, unlike the first embodiment, M'=6, M'=M4'+M1', M4'=M2', N'=6, M1'=3, M2'=3 in the second embodiment.

The other means and steps can be deduced mutatis mutandis from those of the first embodiment.

INSTALLATION AND METHOD ACCORDING TO A THIRD EMBODIMENT OF THE INVENTION

Figure 19:
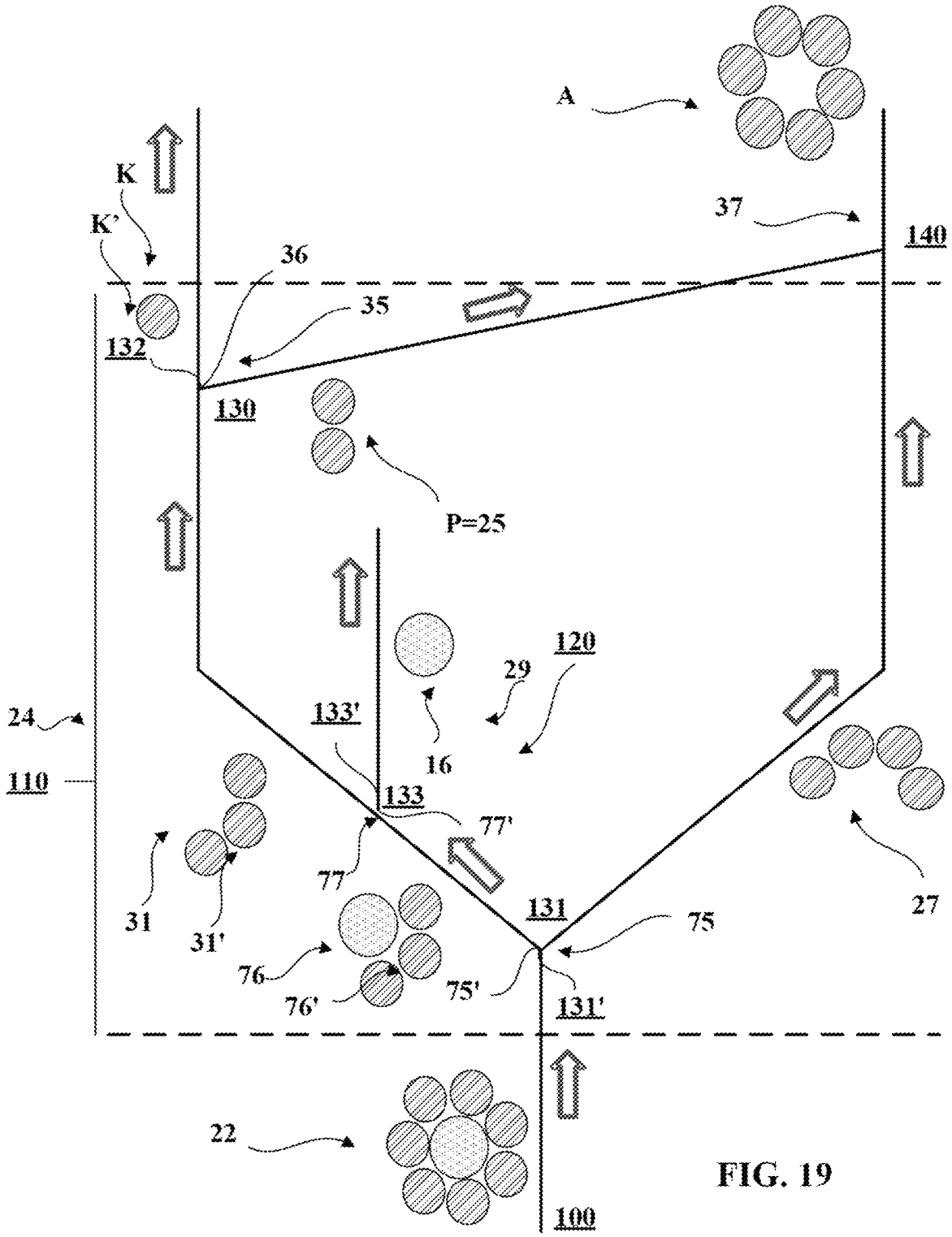
FIGS. 19 to 28 are diagrammatic representations of an installation and of a manufacturing method similar to those of FIGS. 2 and 13 of other embodiments of the invention.

An installation and a method according to the third embodiment of the invention will now be described with reference to FIG. 19. Elements similar to those of the previous embodiments are denoted by identical references.

Unlike the first embodiment, the means 29 for separating the transitory assembly 16 into the precursor ensemble 31, the second split assembly 27 and the transitory core 16 comprise means 75 for separating the transitory assembly 16 into a split ensemble 76 comprising at least one layer 76' constituted by M4'=3 metal filamentary elements helically wound around the transitory core 16 and the second split assembly 27. The M4' metal filamentary elements 14 originate from the layer 13 made up of M' metal filamentary elements 14 of the transitory assembly 22. The split ensemble 76 thus comprises the layer 76' and the transitory core 16, the M4' metal filamentary elements being helically wound around the transitory core 16. In this case, the split ensemble 76 is made up of the layer 76' and of the transitory core 16, the M4' metal filamentary elements being helically wound around the transitory core 16. Here, the separation means 75 comprise means 75' for splitting the transitory assembly 16 into the split ensemble 76 and the second split assembly 27.

Thus, the step 120 of separating the transitory assembly 22 into the precursor ensemble 31, the second split assembly 27 and the transitory core 16 comprises a step 131 of separating the transitory assembly 22 into the split ensemble 76 and the second split assembly 27. Here, the separation step 131 comprises a step 131' of splitting the transitory assembly 22 into the split ensemble 76 and the second split assembly 27.

Unlike the first embodiment, the means 29 for separating the transitory assembly 16 into the precursor ensemble 31, the second split assembly 27 and the transitory core 16 comprise means 77 for separating the split ensemble 76 into the precursor ensemble 31 and the transitory core 16. Here, the separation means 77 comprise means 77' for splitting the split ensemble 76 into the precursor ensemble 31 and the transitory core 16.

Thus, the step 120 of separating the transitory assembly 16 into the precursor ensemble 31, the second split assembly 27 and the transitory core 16 comprises a step 133 of separating the split ensemble 76 into the precursor ensemble 31 and the transitory core 16. Here, the separation step 133 comprises a step 133' of splitting the precursor ensemble 31 and the transitory core 16.

It will be noted that the separation step 133 takes place upstream of the separation step 130. Similarly, the separation means 77 are arranged upstream of the separation means 35.

In addition, it will be noted here that M'=M4'+M2' and M4'=M1". In addition, analogously to the first embodiment, M1'=30.75×M'=5.25, and here M1'=30.70×M'=4.9 with here M'=7, which allows easy separation of the transitory core.

The other means and steps can be deduced mutatis mutandis from those of the previous embodiments.

INSTALLATION AND METHOD ACCORDING TO A FOURTH EMBODIMENT OF THE INVENTION

Figure 20:
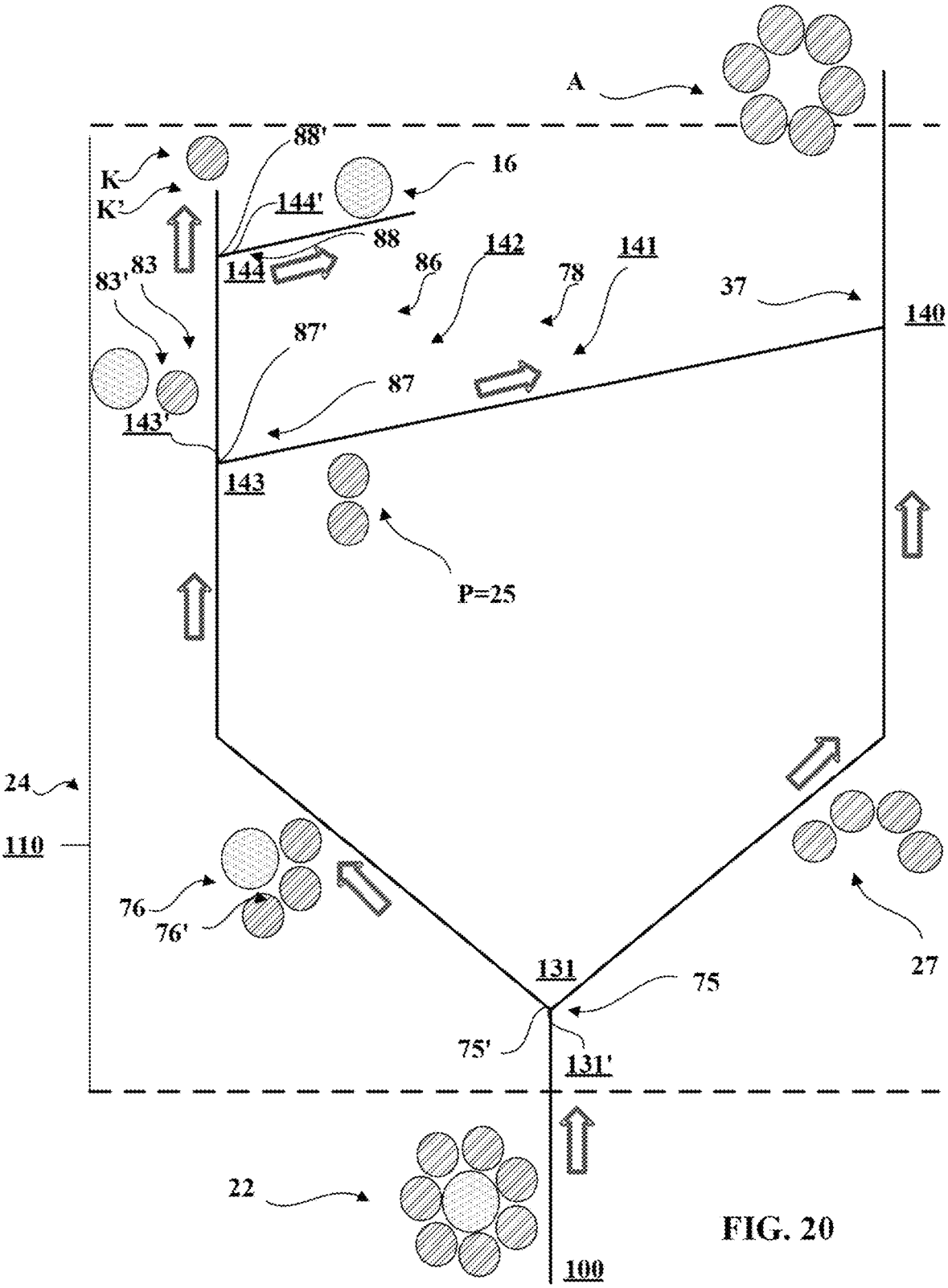

An installation and a method according to the fourth embodiment of the invention will now be described with reference to FIG. 20. Elements similar to those of the previous embodiments are denoted by identical references.

Unlike the third embodiment, the means 24 for separating the transitory assembly 22 into the first split assembly 25, the second split assembly 27 and the transitory core 16 comprise, in addition to the separation means 75, means 78 for separating the split ensemble 76 into the first split assembly 25 and the transitory core 16.

Thus, the step 110 of separating the transitory assembly 22 into the first split assembly 25, the second split assembly 27 and the transitory core 16 comprises a step 141 of separating the split ensemble 76 into the first split assembly 25 and the transitory core 16.

The separation means 78 comprise means 86 for separating the split ensemble 76 into the main ensemble P forming the first split assembly 25, the additional ensemble K and finally the transitory core 16.

Thus, the separation step 141 comprises a step 142 of separating the split ensemble 76 into the main ensemble P forming the first split assembly 25, the additional ensemble K and the transitory core 16.

The separation means 86 comprise means 87 for separating the split ensemble 76 into the main ensemble P forming the first split assembly 25 and a derived ensemble 83 comprising at least one layer 83' consisting of M5'≥1 metal filamentary element(s) helically wound around the transitory core with here M5'=1. The M5'=1 metal filamentary element originates from the layer 76' made up of the M4'=3 metal filamentary elements of the split ensemble 76. Here, the derived ensemble 83 consists of the layer 83' consisting of the M5'=1 metal filamentary element 14 and of the transitory core 16, the M5'=1 metal filamentary element being helically wound around the transitory core 16.

Here, the separation means 87 comprise means 87' for splitting the split ensemble 76 into the main ensemble P forming the first split assembly 25 and the derived ensemble 83.

Thus, the separation step 142 comprises a step 143 of separating the split ensemble 76 into the main ensemble P forming the first split assembly 25 and the derived ensemble 83. Here, the separation step 143 comprises a step 143' of splitting the split ensemble 76 into the main ensemble P forming the first split assembly 25 and the derived ensemble 83.

The separation means 86 also comprise means 88 for separating the derived ensemble 83 into the additional ensemble K and the transitory core 16. Here, the separation means 88 comprise means 88' for splitting the derived ensemble 83 into the additional ensemble K and the transitory core 16.

Thus, the separation step 142 comprises a step 144 of separating the derived ensemble 83 into the additional ensemble K and the transitory core 16. Here, the separation step 144 comprises a step 144' of splitting of the derived ensemble 83 into the additional ensemble K and the transitory core 16.

The separation means 75 are arranged upstream of the separation means 78. Similarly, the separation step 131 takes place upstream of the separation step 141. The separation means 87 are arranged upstream of the separation means 88. Similarly, the separation step 143 takes place upstream of the separation step 144.

In this fourth embodiment, it will be noted that M'=M4'+M2', M4'>M1', M4'=M3+M3' and M3=M1', M4'=M3+M5' and M5'=M3'. In addition, it will be noted here that M'=M4'+M2' and M4'=M1".

The other means and steps can be deduced mutatis mutandis from those of the previous embodiments.

INSTALLATION AND METHOD ACCORDING TO A FIFTH EMBODIMENT OF THE INVENTION

An installation and a method according to the fifth embodiment of the invention will now be described with reference to FIG. 21. Elements similar to those of the previous embodiments are denoted by identical references.

In the fifth embodiment, the means 24 for separating the transitory assembly 22 into the first split assembly 25, the second split assembly 27 and the transitory core 16 comprise means 90 for separating the transitory assembly 22 into a first split ensemble 76 and a second split ensemble 33. Here, the separation means 90 comprise means 90' for splitting the transitory assembly 22 into the first split ensemble 76 and the second split ensemble 33.

Thus, the step 110 of separating the transitory assembly 22 into the first split assembly 25, the second split assembly 27 and the transitory core 16 comprises a step 150 of separating the transitory assembly 22 into the first split ensemble 76 and the second split ensemble 33. Here, the separation step 150 comprises a step 150' of splitting the transitory assembly 22 into the first split ensemble 76 and the second split ensemble 33.

The first split ensemble 76 comprises at least one layer 76' constituted by M6'=3 metal filamentary elements 14 helically wound around a first part 16' of the transitory core, the M6' metal filamentary elements 14 originating from the layer 13 made up of M' metal filamentary elements 14 of the transitory assembly 22. The first split ensemble 76 comprises the layer 76' and the first part 16' of the transitory core, the M6' metal filamentary elements 14 being helically wound around the first part 16' of the transitory core. Here, the first split ensemble 76 consists of the layer 76' constituted by the M6'=3 metal filamentary elements 14 and of the first part 16' of the transitory core, the M6' metal filamentary elements 14 being helically wound around the first part 16' of the transitory core.

The second split ensemble 33 comprises at least one layer 33' constituted by M7'=4 metal filamentary elements 14 helically wound around a second part 16" of the transitory core, the M7' metal filamentary elements 14 originating from the layer 13 made up of the M' metal filamentary elements 14 of the transitory assembly 22. The second split ensemble 33 comprises the layer 33' and the second part 16" of the transitory core, the M7' metal filamentary elements 14 being helically wound around the second part 16" of the transitory core. Here, the second split ensemble 33 consists of the layer 33' constituted by the M7'=4 metal filamentary elements 14 and of the second part 16" of the transitory core, the M7' metal filamentary elements 14 being helically wound around the second part 16" of the transitory core.

The first part 16' of the transitory core and the second part 16" of the transitory core constitute, upstream of the separation means 24 of the transitory assembly, and therefore prior to the separation step 110, the transitory core 16 in its entirety.

The means 24 for separating the transitory assembly 22 into the first split assembly 25, the second split assembly 27 and the transitory core 16 also comprise means 91 for separating the first split ensemble 76 into the first split assembly 25 and the first part of the transitory core 16'. Thus, the step 110 of separating the transitory assembly 22 into the first split assembly 25, the second split assembly 27 and the transitory core 16 comprises a step 151 of separating the first split ensemble 76 into the first split assembly 25 and the first part of the transitory core 16'.

The means 24 for separating the transitory assembly 22 into the first split assembly 25, the second split assembly 27 and the transitory core 16 also comprise means 34 for separating the second split ensemble 33 into the second split assembly 27 and the second part of the transitory core 16". Here, the separation means 34 comprise means 34' for splitting the second split ensemble 33 into the second split assembly 27 and the second part of the transitory core 16". Thus, the step 110 of separating the transitory assembly 22 into the first split assembly 25, the second split assembly 27 and the transitory core 16 comprises a step 124 of separating the second split ensemble 33 into the second split assembly 27 and the second part of the transitory core 16". Here, the separation step 124 comprises a step 124' of splitting the second split ensemble 33 into the second split assembly 27 and the second part of the transitory core 16".

The means 91 for separating the first split ensemble 76 into the first split assembly 25 and the first part of the transitory core 16' comprise means 92 for separating the first split ensemble 76 into the main ensemble P forming the first split assembly 25, the additional ensemble K and the first part of the transitory core 16'. The main ensemble P comprises a layer P', here consists of the layer P', consisting of M3=2 metal filamentary elements 14 wound in a helix, the M3 metal filamentary elements 14 originating from the layer 76' made up of the M6' metal filamentary elements 14 of the first split ensemble 76. The additional ensemble K comprises a layer K', here consists of the layer K', made up of M3'=1 metal filamentary element wound in a helix, the M3' metal filamentary element originating from the layer 76' made up of the M6' metal filamentary elements 14 of the first split ensemble 76. Thus, the step 151 of separating the first split ensemble 76 into the first split assembly 25 and the first part of the transitory core 16' comprises a step 152 of separating the first split ensemble 76 into the main ensemble P forming the first split assembly 25, the additional ensemble K and the first part of the transitory core 16'.

The means 92 for separating the first split ensemble 76 into the main ensemble P forming the first split assembly 25, the additional ensemble K and the first part of the transitory core 16' comprise means 77 for separating the first split ensemble 76 into the precursor ensemble 31 and the first part of the transitory core 16'. Here, the separation means 77 comprise means 77' for splitting the first split ensemble 76 into the precursor ensemble 31 and the first part of the transitory core 16'. Thus, the step 152 of separating the first split ensemble 76 into the main ensemble P forming the first split assembly 25, the additional ensemble K and the first part of the transitory core 16' comprises a step 133 of separating the first split ensemble 76 into the precursor ensemble 31 and the first part of the transitory core 16'. Here, the separation step 133 comprises a step 133' of splitting of the first split ensemble 76 into the precursor ensemble 31 and the first part of the transitory core 16'.

The means 92 for separating the first split ensemble 76 into the main ensemble P forming the first split assembly 25, the additional ensemble K and the first part of the transitory core 16' also comprise means 35 for separating the precursor ensemble 31 into the main ensemble P forming the first split assembly 25 and the additional ensemble K. Here, the separation means 35 comprise means 36 for splitting the precursor ensemble 31 into the main ensemble P forming the first split assembly 25 and the additional ensemble K. Thus, the step 152 of separating the first split ensemble 76 into the main ensemble P forming the first split assembly 25, the additional ensemble K and the first part of the transitory core 16' also comprises a step 130 of separating the precursor ensemble 31 into the main ensemble P forming the first split assembly 25 and the additional ensemble K. Here, the separation step 130 comprises a step 132 of splitting the precursor ensemble 31 into the main ensemble P forming the first split assembly 25 and the additional ensemble K.

The separation means 90 are arranged upstream of the separation means 91. Similarly, the separation step 150 takes place upstream of the separation step 151.

The separation means 90 are arranged upstream of the separation means 34. Similarly, the separation step 150 takes place upstream of the separation step 124.

The separation means 77 are arranged upstream of the separation means 35. Similarly, the separation step 133 takes place upstream of the separation step 130.

In this fifth embodiment, it will be noted that M6'>M1', M7'=M2', M'=M6'+M7', M6'=M3+M3', M3=M1'. M6'=M1", M1"=M3+M3', M6'=M1" and M1"=M3+M3'.

In addition, analogously to the first and third embodiments, M1'=3≤0.75×M'=5.25, and here M1=3≤0.70×M'=4.9 with M'=7, which allows easy separation of the first part 16' of the transitory core, and M2'=4≤0.75×M'=5.25, and here M2'=4≤0.70×M'=4.9, which allows easy separation of the second part 16' of the transitory core.

The other means and steps can be deduced mutatis mutandis from those of the previous embodiments.

INSTALLATION AND METHOD ACCORDING TO A SIXTH EMBODIMENT OF THE INVENTION

An installation and a method according to the sixth embodiment of the invention will now be described with reference to FIG. 22. Elements similar to those of the previous embodiments are denoted by identical references.

Unlike the fifth embodiment, in the sixth embodiment, the means 92 for separating the first split ensemble 76 into the main ensemble P forming the first split assembly 25, the additional ensemble K and the first part of the transitory core 16' comprise means 87 for separating the first split ensemble 76 into the main ensemble P forming the first split assembly 25 and the derived ensemble 83. The derived ensemble 83 comprises at least one layer 83' made up of M5'=1 metal filamentary element helically wound around the first part of the transitory core 16', the M5'=1 metal filamentary element 14 originating from the layer 76' made up of the M6'=3 metal filamentary elements of the first split ensemble 76. The derived ensemble 83 here consists of the layer 83' and of the first part of the transitory core 16', the M5'=1 metal filamentary element 14 of the layer 83' being helically wound around the first part of the transitory core 16'. Here, the separation means 87 comprise means 87' for splitting the first split ensemble 76 into the main ensemble P forming the first split assembly 25 and the derived ensemble 83. Thus, the step 152 of separating the first split ensemble 76 into the main ensemble P forming the first split assembly 25, the additional ensemble K and the first part of the transitory core 16' comprises a step 143 of separating the first split ensemble 76 into the main ensemble P forming the first split assembly 25 and the derived ensemble 83. Here, the separation step 143 comprises a step 143' of splitting of the first split ensemble 76 into the main ensemble P forming the first split assembly 25 and the derived ensemble 83.

The means 92 for separating the first split ensemble 76 into the main ensemble P forming the first split assembly 25, the additional ensemble K and the first part of the transitory core 16' also comprise means 88 for separating the derived ensemble 83 into the additional ensemble K and the first part of the transitory core 16'. Here, the separation means 88 comprise means 88' for splitting the derived ensemble 83 into the additional ensemble K and the first part of the transitory core 16'. Thus, the step 152 of separating the first split ensemble 76 into the main ensemble P forming the first split assembly 25, the additional ensemble K and the first part of the transitory core 16' comprises a step 144 of separating the derived ensemble 83 into the additional ensemble K and the first part of the transitory core 16'. Here, the separation step 144 comprises a step 144' of splitting of the derived ensemble 83 into the additional ensemble K and the first part of the transitory core 16'.

The separation means 87 are arranged upstream of the separation means 88. Similarly, the separation step 143 takes place upstream of the separation step 144.

In this sixth embodiment, M6'=M3+M5', M3=M1' and M5'=M3'.

The other means and steps can be deduced mutatis mutandis from those of the previous embodiments.

INSTALLATION AND METHOD ACCORDING TO A SEVENTH EMBODIMENT OF THE INVENTION

Figure 23:
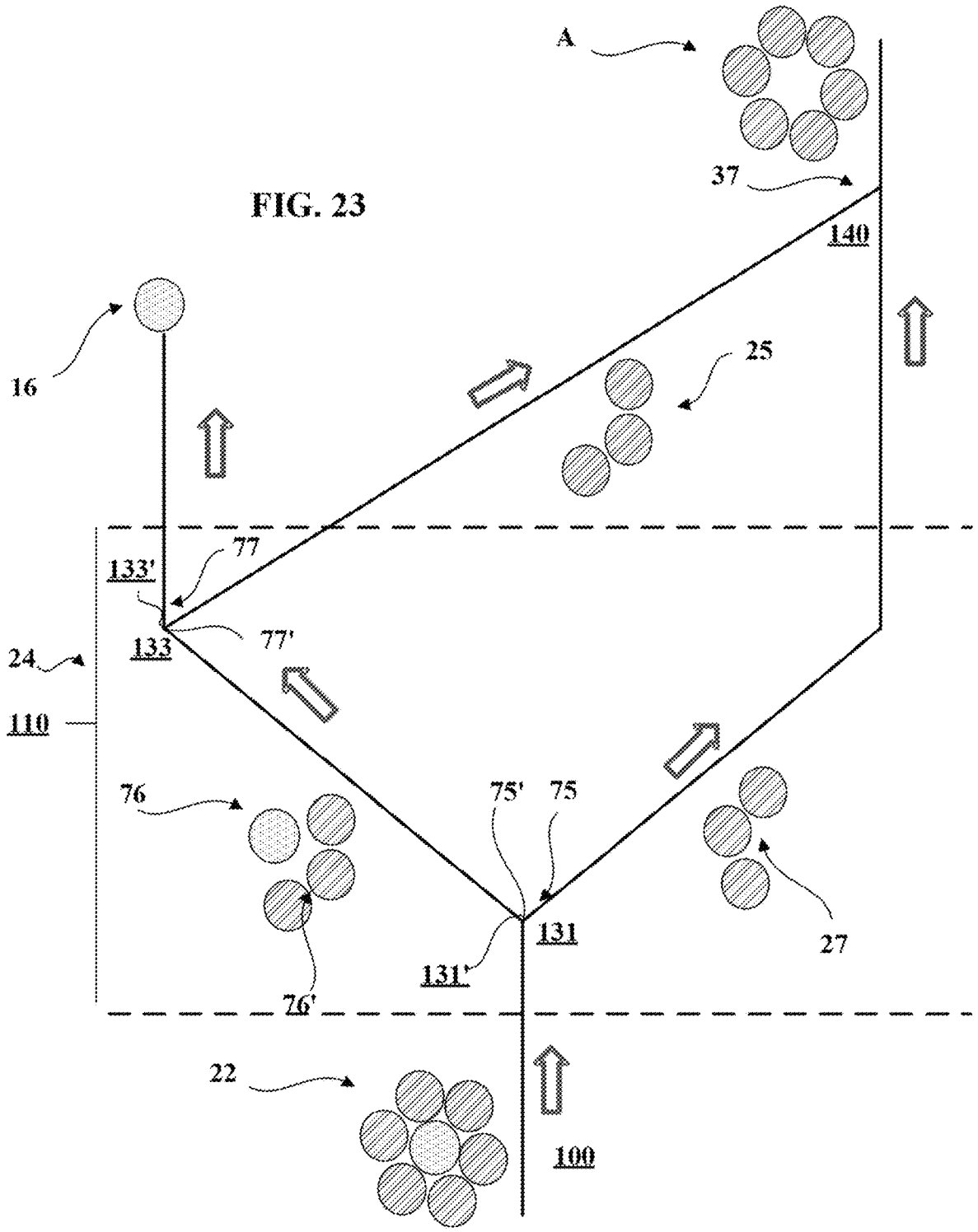

An installation and a method according to the seventh embodiment of the invention will now be described with reference to FIG. 23. Elements similar to those of the previous embodiments are denoted by identical references.

Unlike the second embodiment, the means 24 for separating the transitory assembly 22 into the first split assembly 25, the second split assembly 27 and the transitory core 16 comprise means 75 for separating the transitory assembly 22 into the split ensemble 76 and the second split assembly 27. Here, the separation means 75 comprise means 75' for splitting the transitory assembly 22 into the split ensemble 76 and the second split assembly 27. Thus, the step 110 of separating the transitory assembly 22 into the first split assembly 25, the second split assembly 27 and the transitory core 16 comprises a step 131 of separating the transitory assembly 22 into the split ensemble 76 and the second split assembly 27. Here, the separation step 131 comprises a step 131' of splitting the transitory assembly 22 into the split ensemble 76 and the second split assembly 27.

Unlike the second embodiment, the means 24 for separating the transitory assembly 22 into the first split assembly 25, the second split assembly 27 and the transitory core 16 comprise means 77 for separating the split ensemble 76 into the first split assembly 25 and the transitory core 16. In this case, the separation means 77 comprise means 77' for splitting the split ensemble 76 into the first split assembly 25 and the transitory core 16. Thus, the step 110 of separating the transitory assembly 22 into the first split assembly 25, the second split assembly 27 and the transitory core 16 comprises a step 133 of separating the split ensemble 76 into the first split assembly 25 and the transitory core 16. In this case, the separation step 133 comprises a step 133' of splitting the split ensemble 76 into the second split assembly 25 and the transitory core 16.

The separation means 75 are arranged upstream of the separation means 77. Similarly, the separation step 131 takes place upstream of the separation step 133.

In this seventh embodiment, M'=M4'+M2' and M4'=M1'.

The other means and steps can be deduced mutatis mutandis from those of the previous embodiments.

INSTALLATION AND METHOD ACCORDING TO AN EIGHTH EMBODIMENT OF THE INVENTION

Figure 24:
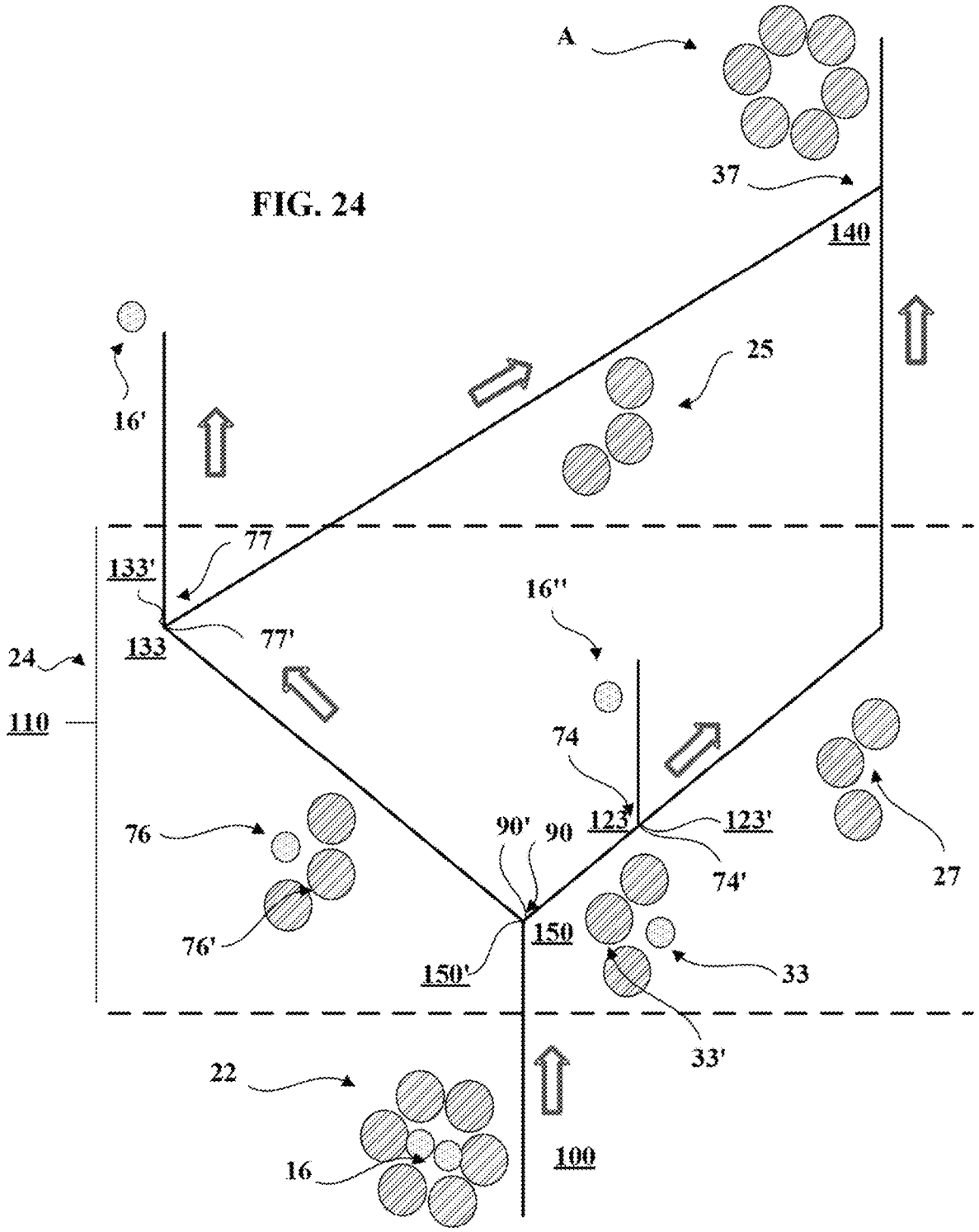

An installation and a method according to the eighth embodiment of the invention will now be described with reference to FIG. 24. Elements similar to those of the previous embodiments are denoted by identical references.

In the eighth embodiment, the means 24 for separating the transitory assembly 22 into the first split assembly 25, the second split assembly 27 and the transitory core 16 comprise means 90 for separating the transitory assembly 22 into the first split ensemble 76 comprising at least one layer 76' constituted by M6'=3 metal filamentary elements 14 helically wound around a first part 16' of the transitory core, and the second split ensemble 33 comprising at least one layer 33' constituted by the M7'=3 metal filamentary elements 14 helically wound around a second part 16" of the transitory core.

The first split ensemble 76 here consists of the layer 76' made up of the M6' metal filamentary elements 14 and of the first part of the transitory core 16', the M6' metal filamentary elements being helically wound around the first part of the transitory core 16'. The second split ensemble 33 consists of the layer 33' consisting of the M7' metal filamentary elements 14 and of the second part of the transitory core 16", the M7' metal filamentary elements 14 being helically wound around the second part of the transitory core 16".

Figure 21:
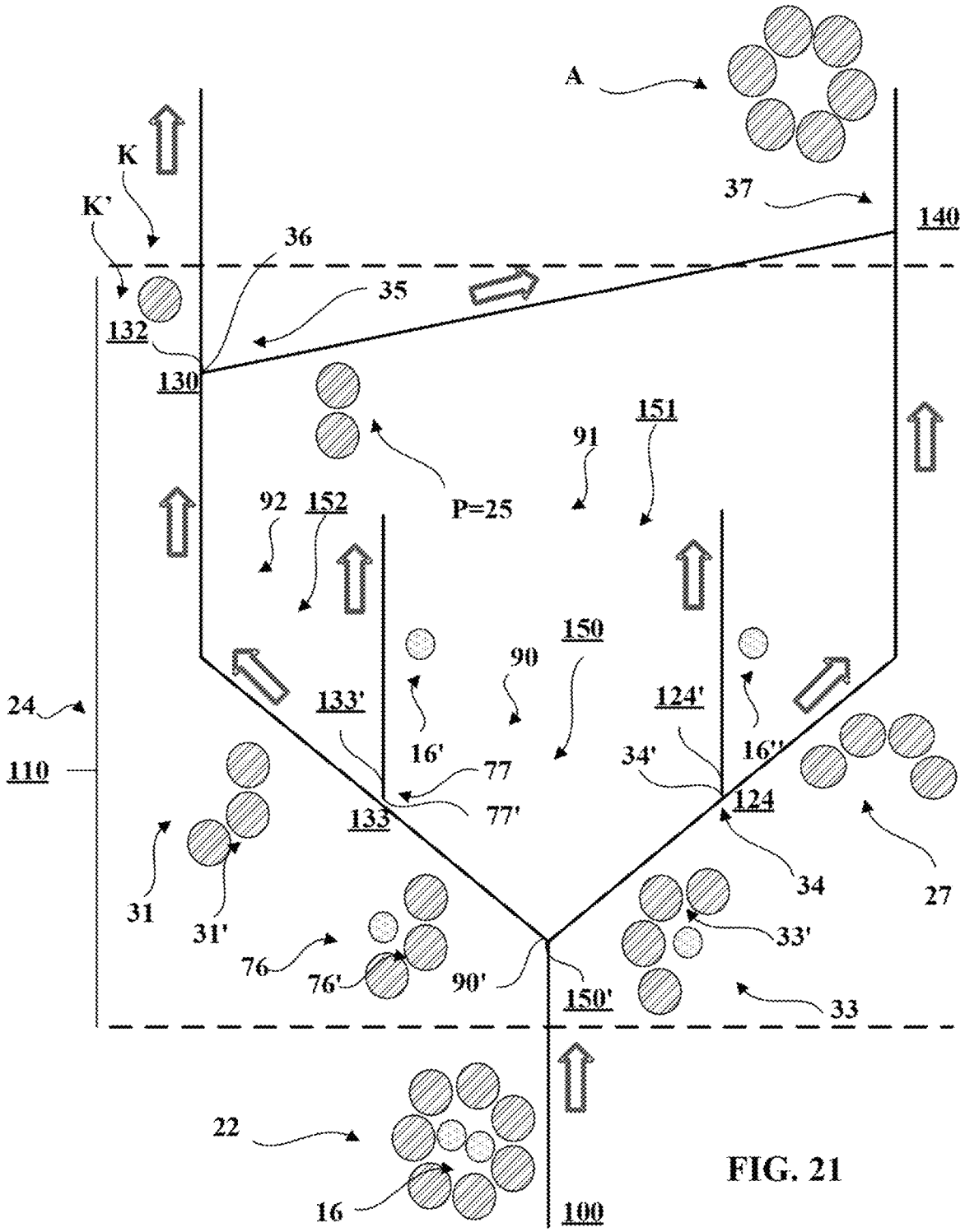
Figure 22:
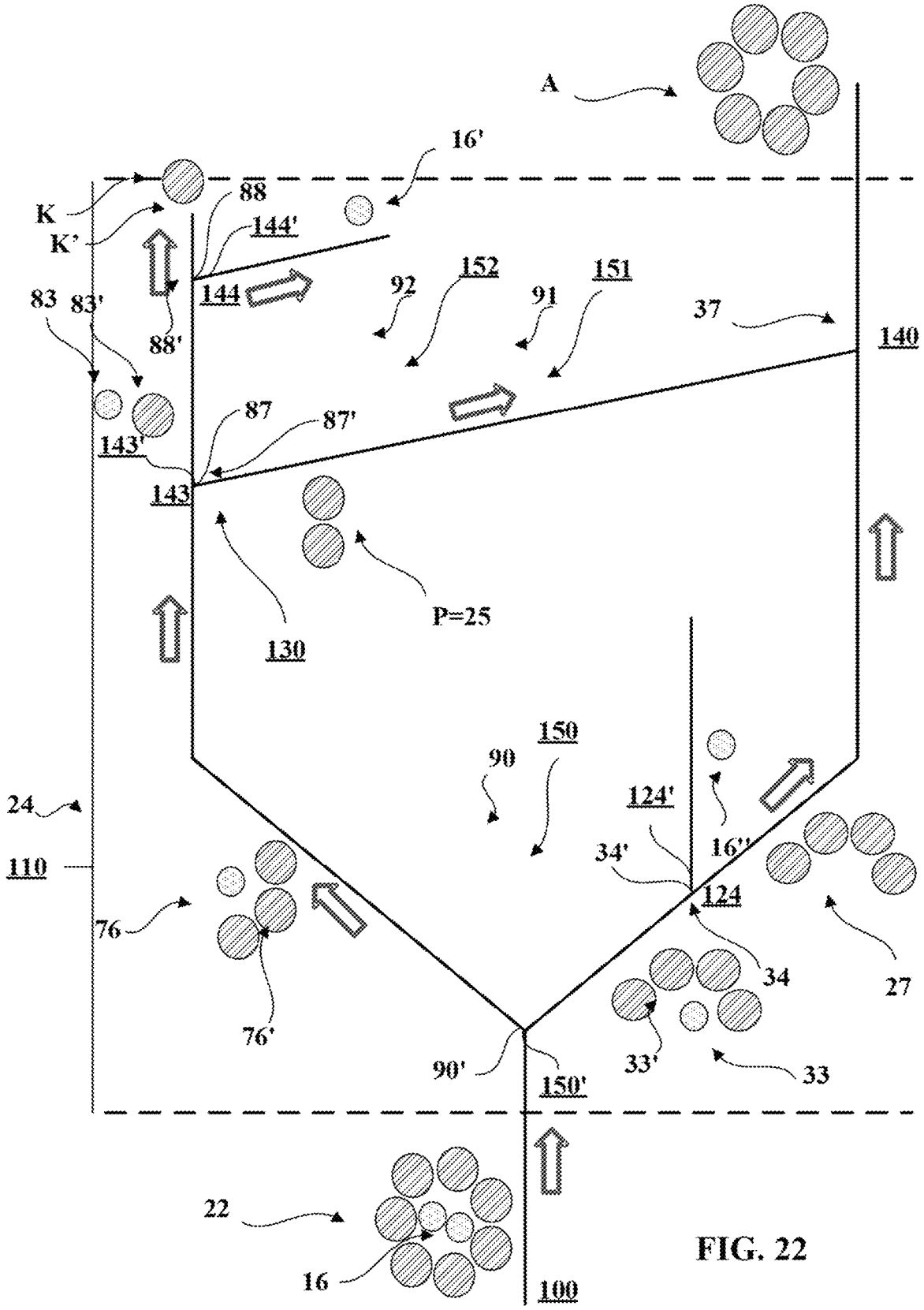

As in the embodiments illustrated in FIGS. 21 and 22, the first part of the transitory core 16' and the second part of the transitory core 16" constitute, upstream of the means 24 for separating the transitory assembly 22 and prior to the step 110 of separating the transitory assembly 22, the transitory core 16 in its entirety.

Here, the separation means 90 comprise means 90' for splitting the transitory assembly 22 into the first split ensemble 76 and the second split ensemble 33. Thus, the step 110 of separating the transitory assembly 22 into the first split assembly 25, the second split assembly 27 and the transitory core 16 comprises a step 150 of separating the transitory assembly 22 into the first split ensemble 76 and the second split ensemble 33. Here, the separation step 150 comprises a step 150' of splitting the transitory assembly 22 into the first split ensemble 76 and the second split ensemble 33.

Analogously to the seventh embodiment, the means 24 for separating the transitory assembly 22 into the first split assembly 25, the second split assembly 27 and the transitory core 16 comprise means 77 for separating the first split ensemble 76 into the first split assembly 25 and the first part 16' of the transitory core. Here, the separation means 77 comprises means 77' for splitting the first split ensemble 76 into the first split assembly 25 and the first part 16' of the transitory core. Thus, the step 110 of separating the transitory assembly 22 into the first split assembly 25, the second split assembly 27 and the transitory core 16 comprises a step 133 of separating the first split ensemble 76 into the first split assembly 25 and the first part 16' of the transitory core. Here, the separation step 133 comprises a step 133' of splitting of the first split ensemble 76 into the first split assembly 25 and the first part 16' of the transitory core.

Analogously to the second embodiment, the means 24 for separating the transitory assembly 22 into the first split assembly 25, the second split assembly 27 and the transitory core 16 comprise means 74 for separating the second split ensemble 33 into the second split assembly 27 and the second part 16" of the transitory core. Here, the separation means 74 comprise means 74' for splitting the second split ensemble 33 into the second split assembly 27 and the second part 16" of the transitory core. Thus, the step 110 of separating the transitory assembly 22 into the first split assembly 25, the second split assembly 27 and the transitory core 16 comprises a step 123 of separating the second split ensemble 33 into the second split assembly 27 and the second 16" part of the transitory core. Here, the separation step 123 comprises a step 123' of splitting the second split ensemble 33 into the second split assembly 27 and the second part 16" of the transitory core.

The separation means 90 are arranged upstream of the separation means 77 and 74. Similarly, the separation step 150 takes place upstream of each separation step 133 and 123.

In this eighth embodiment, M'=M6'+M7', M6'=M1' and M7'=M2'.

The other means and steps can be deduced mutatis mutandis from those of the previous embodiments.

INSTALLATION AND METHOD ACCORDING TO A NINTH EMBODIMENT OF THE INVENTION

Figure 25:
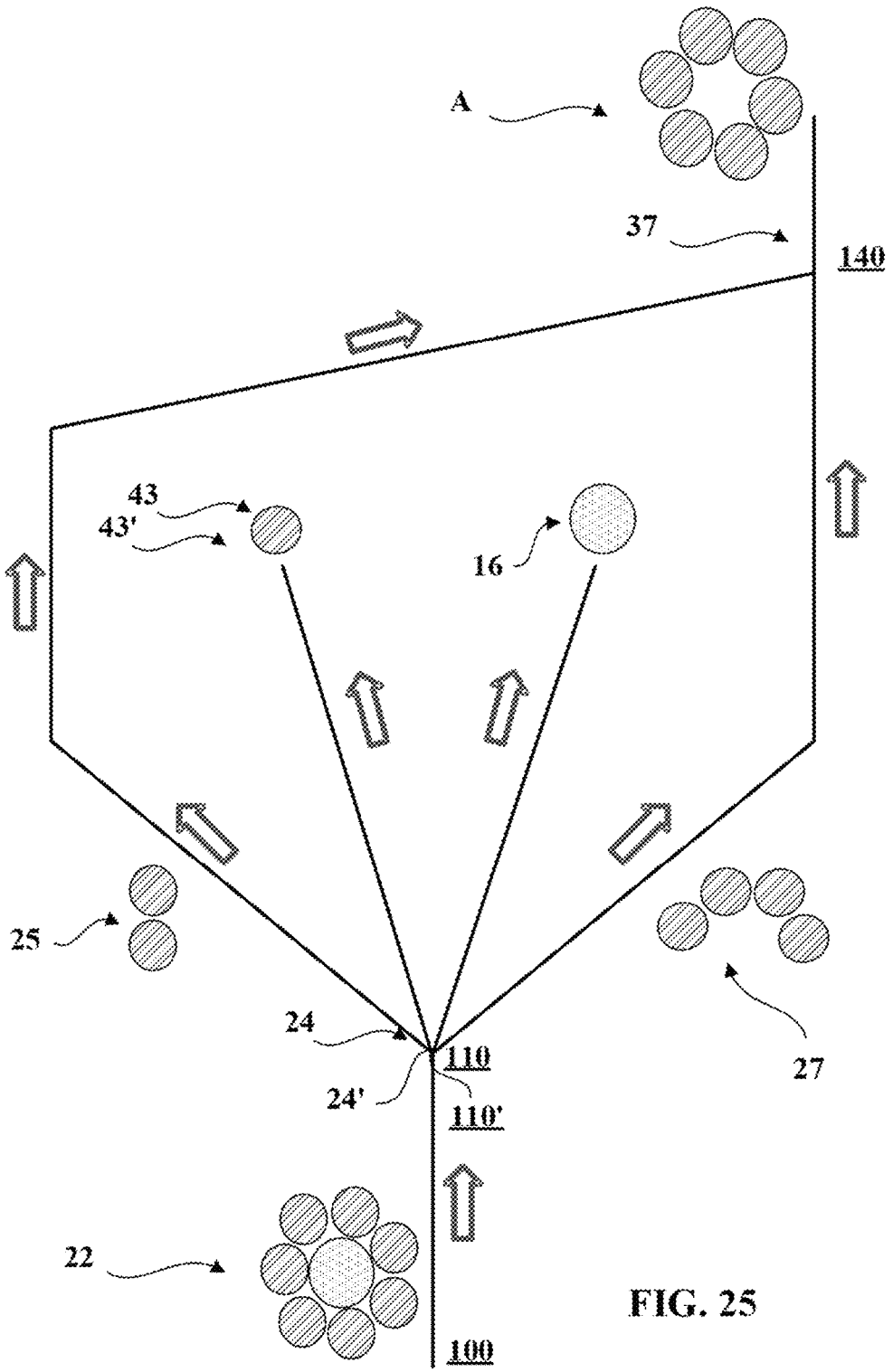

An installation and a method according to the ninth embodiment of the invention will now be described with reference to FIG. 25. Elements similar to those of the previous embodiments are denoted by identical references.

Unlike the first, third and fourth embodiments, the means 24 for separating the transitory assembly 22 into the first split assembly 25, the second split assembly 27 and the transitory core 16 or one or more ensembles comprising the transitory core 16 comprise, upstream of the reassembly means 37, means 24' for splitting the transitory assembly 22 into the first split assembly 25, the second split assembly 27, the transitory core 16 and finally a split ensemble 43 comprising at least one layer 43', here made up of layer 43', made up of M4'=1 metal filamentary element wound in a helix, the M4'=1 metal filamentary element originating from the layer 13 made up of the M' metal filamentary elements 14 of the transitory assembly 22. Similarly, the step 110 of separating the transitory assembly 22 into the first split assembly 25, the second split assembly 27 and the transitory core 22 or one or more ensembles comprising the transitory core 22 comprises, upstream of the reassembly step 140, a step 110' of splitting the transitory assembly 22 into the first split assembly 25, the second split assembly 27, the transitory core 16 and finally the split ensemble 43.

INSTALLATION AND METHOD ACCORDING TO A TENTH EMBODIMENT OF THE INVENTION

Figure 26:
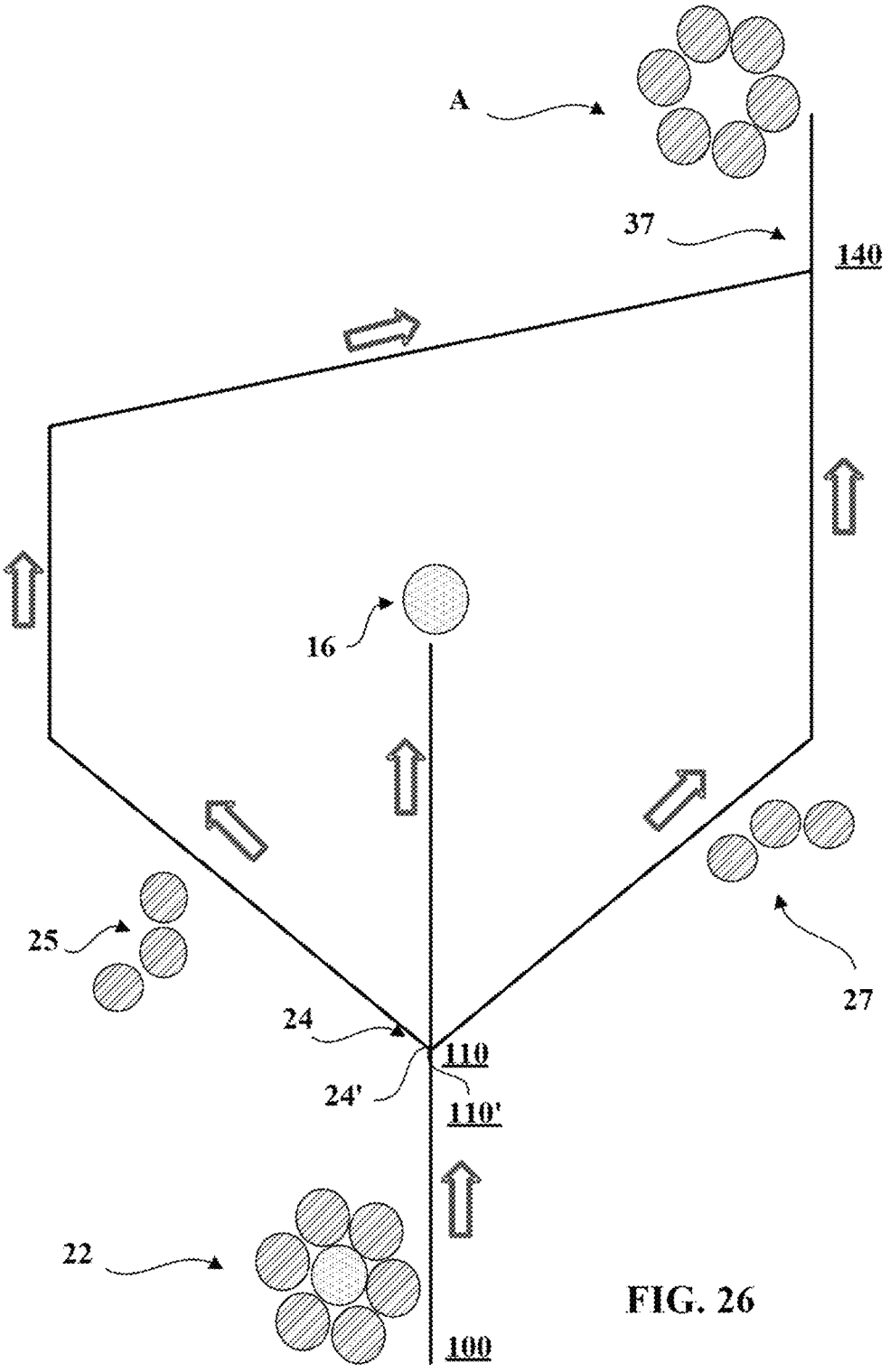

An installation and a method according to the tenth embodiment of the invention will now be described with reference to FIG. 26. Elements similar to those of the previous embodiments are denoted by identical references.

Unlike the second embodiment, the means 24 for separating the transitory assembly 22 into the first split assembly 25, the second split assembly 27 and the transitory core 22 or one or more ensembles comprising the transitory core 22 comprise, upstream of the reassembly means 37, means 24' for splitting the transitory assembly 22 into the first split assembly 25, the second split assembly 27 and the transitory core 22. Similarly, the step 110 of separating the transitory assembly 22 into the first split assembly 25, the second split assembly 27 and the transitory core 22 or one or more ensembles comprising the transitory core 22 comprises, upstream of the reassembly step 140, a step 110' of splitting of the transitory assembly 22 into the first split assembly 25, the second split assembly 27 and the transitory core 22.

INSTALLATION AND METHOD ACCORDING TO AN ELEVENTH EMBODIMENT OF THE INVENTION

Figure 27:
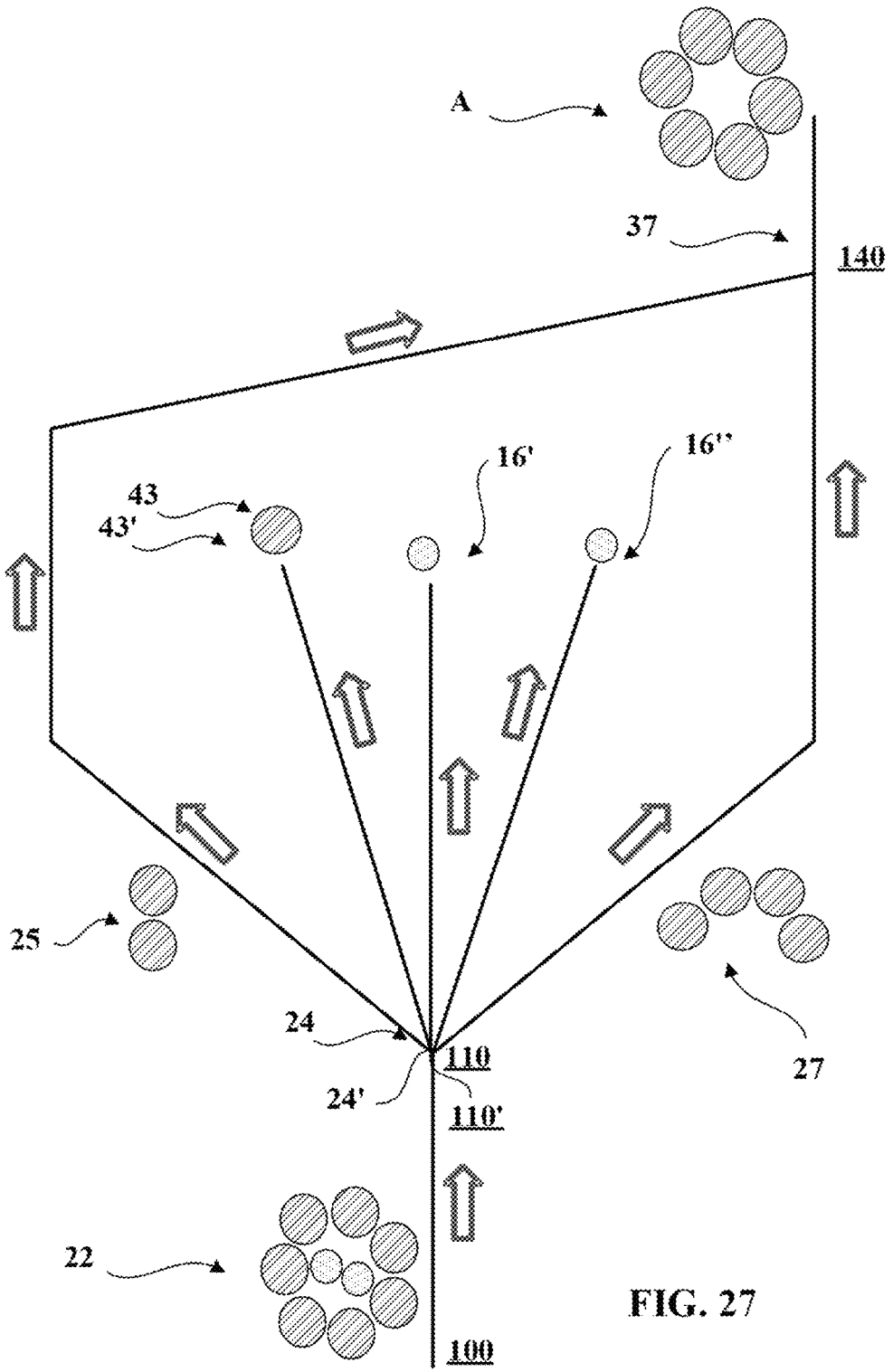

An installation and a method according to the eleventh embodiment of the invention will now be described with reference to FIG. 27. Elements similar to those of the previous embodiments are denoted by identical references.

Unlike the fifth and sixth embodiments, the means 24 for separating the transitory assembly 22 into the first split assembly 25, the second split assembly 27 and the transitory core 22 or one or more ensembles comprising the transitory core 22 comprise, upstream of the reassembly means 37, means 24' for splitting the transitory assembly 22 into the first split assembly 25, the second split assembly 27, a first part 16' of the transitory core, a second part 16" of the transitory core and a split ensemble 43 similar to that of the ninth embodiment. The first part 16' of the transitory core and the second part 16" of the transitory core constitute, upstream of the means 24 for separating the transitory assembly 22, the transitory core 16. Similarly, the step 110 of separating the transitory assembly 22 into the first split assembly 25, the second split assembly 27 and the transitory core 22 or one or more ensembles comprising the transitory core 22 comprises, upstream of the reassembly step 140, a step 110' of splitting the transitory assembly 22 into the first split assembly 25, the second split assembly 27, the first part 16' of the transitory core, the second part 16" of the transitory core and the split ensemble 43.

INSTALLATION AND METHOD ACCORDING TO A TWELFTH EMBODIMENT OF THE INVENTION

Figure 28:
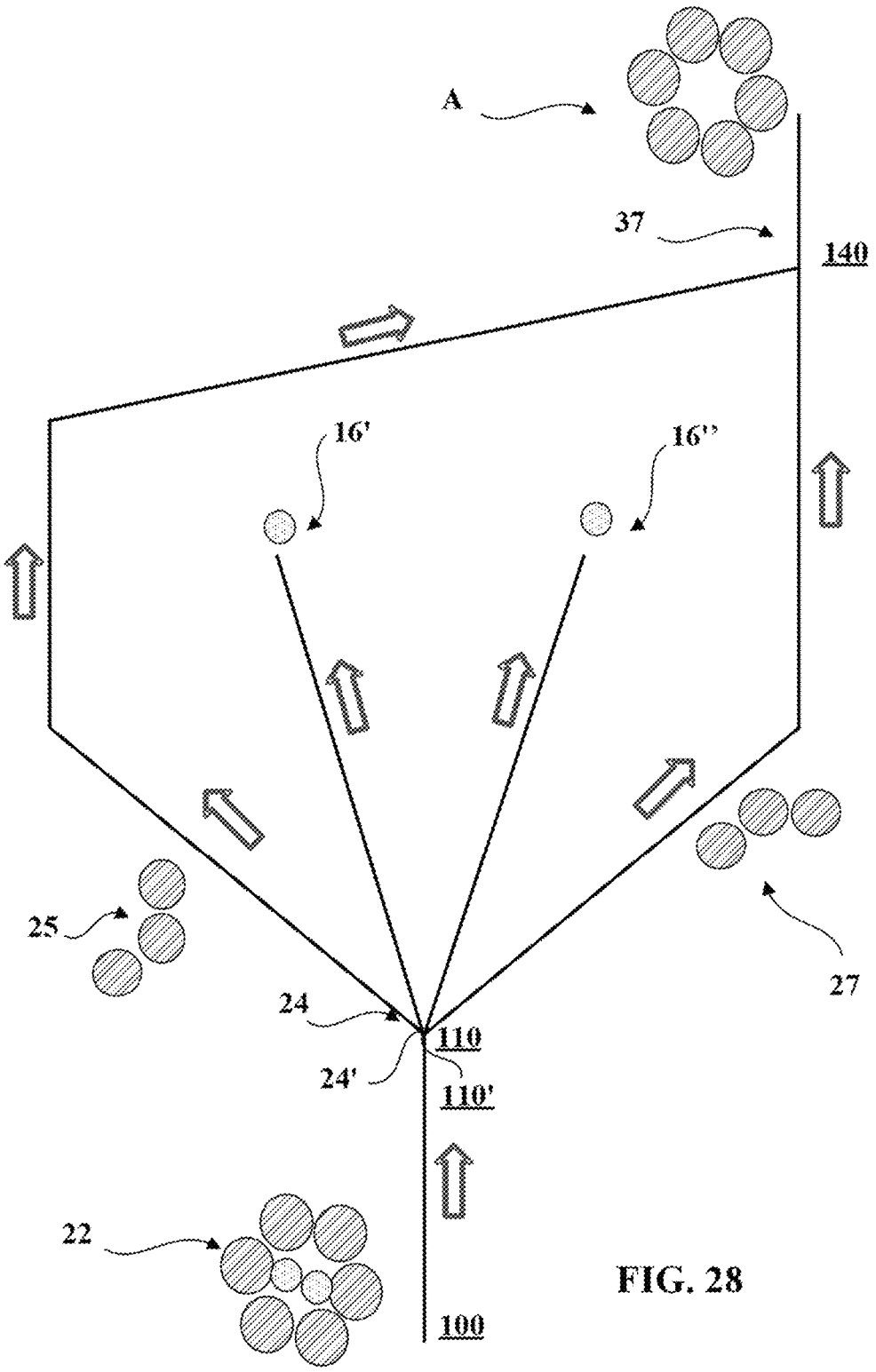

An installation and a method according to the twelfth embodiment of the invention will now be described with reference to FIG. 28. Elements similar to those of the previous embodiments are denoted by identical references.

Unlike the eighth embodiment, the means 24 for separating the transitory assembly 22 into the first split assembly 25, the second split assembly 27 and the transitory core 22 comprise, upstream of the reassembly means 37, means 24' for splitting of the transitory assembly 22 into the first split assembly 25, the second split assembly 27, a first part 16' of the transitory core and a second part 16" of the transitory core. The first part 16' of the transitory core and the second part 16" of the transitory core constitute, upstream of the means 24 for separating the transitory assembly 22, the transitory core 16. Similarly, the step 110 of separating the transitory assembly 22 into the first split assembly 25, the second split assembly 27 and the transitory core 22 comprises, upstream of the reassembly step 140, a step 110' of splitting the transitory assembly 22 into the first split assembly 25, the second split assembly 27, the first part 16' of the transitory core and the second part 16" of the transitory core.

The invention is not limited to the embodiments described above. Indeed, it is quite possible to envisage using, without departing from the scope of the invention, a method and an installation in which the step and the means for separating the transitory assembly into at least the first split assembly, the second split assembly and the transitory core or one or more ensembles comprising the transitory core is a step or are means for separating the transitory assembly into the first split assembly, the second split assembly and an ensemble comprising the transitory core and filamentary elements originating from the transitory assembly. In such embodiments, for example, the separation step 144 and the separation means 88 of FIGS. 20 and 22 are omitted.

It is also possible to envisage a step of separating, respectively means for separating, the transitory assembly into more than the first and second split assemblies AF1, AF2, for example three or even four split assemblies. In these embodiments, the reassembly step, respectively the reassembly means, may allow the reassembly of more than the first and second split assemblies AF1, AF2, for example the reassembly of three or even four split assemblies.

The invention claimed is:

1. A method of manufacturing a final assembly comprising at least one layer made up of N'>1 helically wound metal filamentary elements, the method comprising:

a step of supplying a transitory assembly comprising at least one layer made up of M'>1 metal filamentary elements helically wound around a transitory core; and a step of separating the transitory assembly into at least:

a first split assembly comprising at least one layer made up of M1'>1 helically wound metal filamentary elements, the M1' metal filamentary element originating from the layer made up of M'>1 metal filamentary elements of the transitory assembly, a second split assembly comprising at least one layer made up of M2'>1 helically wound metal filamentary elements, the M2' metal filamentary elements originating from the layer made up of M'>1 metal filamentary elements of the transitory assembly, and the transitory core or one or more ensembles comprising the transitory core; and a step of reassembling at least the first split assembly with the second split assembly to form the layer made up of N' helically wound metal filamentary elements, wherein the separation step and the reassembly step are performed such that M1'+M2'<M'.

2. The method according to claim 1, wherein the separation step comprises, upstream of the reassembly step:

a step of separating the transitory assembly into:

a precursor ensemble comprising at least one layer consisting of M1">1 helically wound metal filamentary elements, the M1" metal filamentary elements originating from the layer made up of M'>1 metal filamentary elements of the transitory assembly, the second split assembly, and the transitory core or one or more ensembles comprising the transitory core; and a step of separating the precursor ensemble into:

a main ensemble comprising at least one layer made up of M3≥1 helically wound metal filamentary elements, the M3≥1 metal filamentary elements originating from the layer made up of the M1"≥1 metal filamentary elements of the precursor ensemble, the main ensemble forming the first split assembly, and an additional ensemble comprising at least one layer made up of M3'≥1 helically wound metal filamentary elements, the M3'≥1 metal filamentary elements originating from the layer made up of the M1"≥1 metal filamentary elements of the precursor ensemble.

3. The method according to claim 2, wherein the step of separating the transitory assembly into the precursor ensemble, the second split assembly, and the transitory core or one or more ensembles comprising the transitory core comprises:

a step of separating the transitory assembly into:

a split ensemble comprising at least one layer made up of M4'>1 metal filamentary elements helically wound around the transitory core, the M4' metal filamentary elements originating from the layer made up of M' metal filamentary elements of the transitory assembly, and the second split assembly; and a step of separating the split ensemble into:

the precursor ensemble, and the transitory core or one or more ensembles comprising the transitory core.

4. The method according to claim 2, wherein the step of separating the transitory assembly into the precursor ensemble, the second split assembly and the transitory core or one or more ensembles comprising the transitory core comprises:

a step of separating the transitory assembly into:

a split ensemble comprising at least one layer made up of M4'>1 metal filamentary elements helically wound around the transitory core, the M4' metal filamentary elements originating from the layer made up of M'>1 metal filamentary elements of the transitory assembly, and the precursor ensemble; and a step of separating the split ensemble into:

the second split assembly, and the transitory core or one or more ensembles comprising the transitory core.

5. The method according to claim 1, wherein the separation step comprises, upstream of the reassembly step:

a step of separating the transitory assembly into:

a split ensemble comprising at least one layer made up of M4'>1 metal filamentary elements helically wound around the transitory core, the M4' metal filamentary elements originating from the layer made up of M' metal filamentary elements of the transitory assembly, and the second split assembly; and a step of separating the split ensemble into:

the first split assembly, and the transitory core or one or more ensembles comprising the transitory core.

6. The method according to claim 1, wherein the separation step comprises, upstream of the reassembly step:

a step of splitting the transitory assembly into:

the first split assembly, the second split assembly, the transitory core or one or more ensembles comprising the transitory core, and a split ensemble comprising at least one layer made up of M4'≥1 helically wound metal filamentary elements, the M4' metal filamentary elements originating from the layer made up of M' metal filamentary elements of the transitory assembly.

7. The method according to claim 1, wherein M' ranges from 4 to 18.

* * * * *